United States Patent [19]

Teranishi

[11] Patent Number: 5,063,911

[45] Date of Patent: Nov. 12, 1991

[54] MASSAGE MACHINE

[75] Inventor: Akihiko Teranishi, Nagoya, Japan

[73] Assignee: Teranishi Electric Works Ltd., Aichi, Japan

[21] Appl. No.: 481,564

[22] Filed: Feb. 20, 1990

[30] Foreign Application Priority Data

Feb. 24, 1989 [JP] Japan ..... 1-44386

[51] Int. Cl.[5] ..... A61H 1/00; A61H 7/00

[52] U.S. Cl. ..... 128/32; 128/46; 128/49; 128/56; 128/60

[58] Field of Search ..... 128/45, 46, 59, 60, 128/61, 32, 48, 49, 35, 36, 41

[56] References Cited

U.S. PATENT DOCUMENTS 3,926,180 12/1975 Zambelli ..... 128/32
4,505,267 3/1985 Inada ..... 128/59
4,620,529 11/1986 Kurosawa ..... 128/32 X
4,733,655 3/1988 Smal ..... 128/60 X
4,777,940 10/1988 Yamasaki ..... 128/59
4,785,798 11/1988 Yamasaki ..... 128/59 X

*Primary Examiner*—Edgar S. Burr
*Assistant Examiner*—Moshe I. Cohen
*Attorney, Agent, or Firm*—Wenderoth, Lind & Ponack

[57] ABSTRACT

In a massage machine, a pair of rotatable shafts are mounted to extend through a top plate of a housing, and a pair of kneading balls are loosely fitted respectively to the top ends of the shafts. The shafts include oblique portions such that the kneading balls are rotated eccentrically to provide an oscillating motion. Cover pieces having spherical surfaces corresponding to the oscillating traces of the kneading balls are mounted about the rotatable shafts and interposed in a gap formed in the top plate of the housing. The kneading balls can be oscillated so that portions thereof circulate along the outer surfaces of the cover pieces. A vibration plate can be supported above the top plate by an elastic support leg, such that the massage machine can provide a kneading effect and a vibration effect simultaneously.

19 Claims, 15 Drawing Sheets

FIG. 27-PRIOR ART
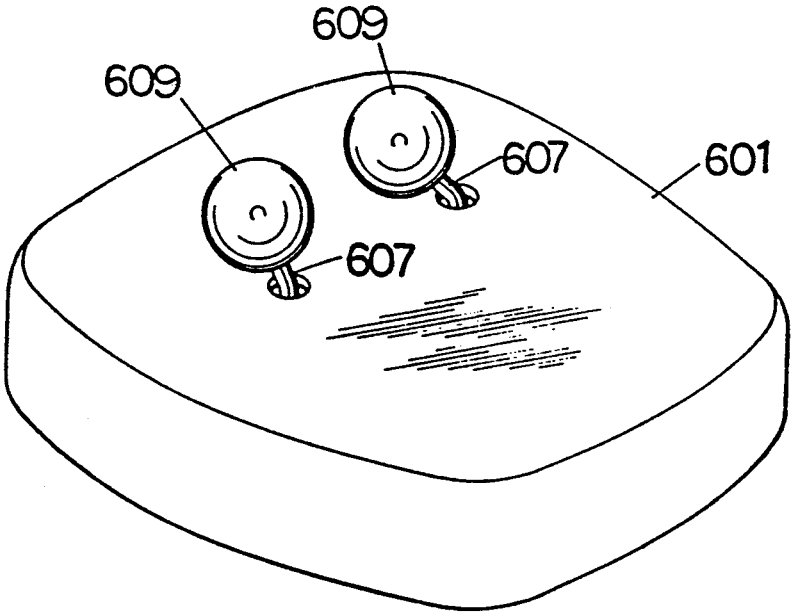
FIG. 28-PRIOR ART
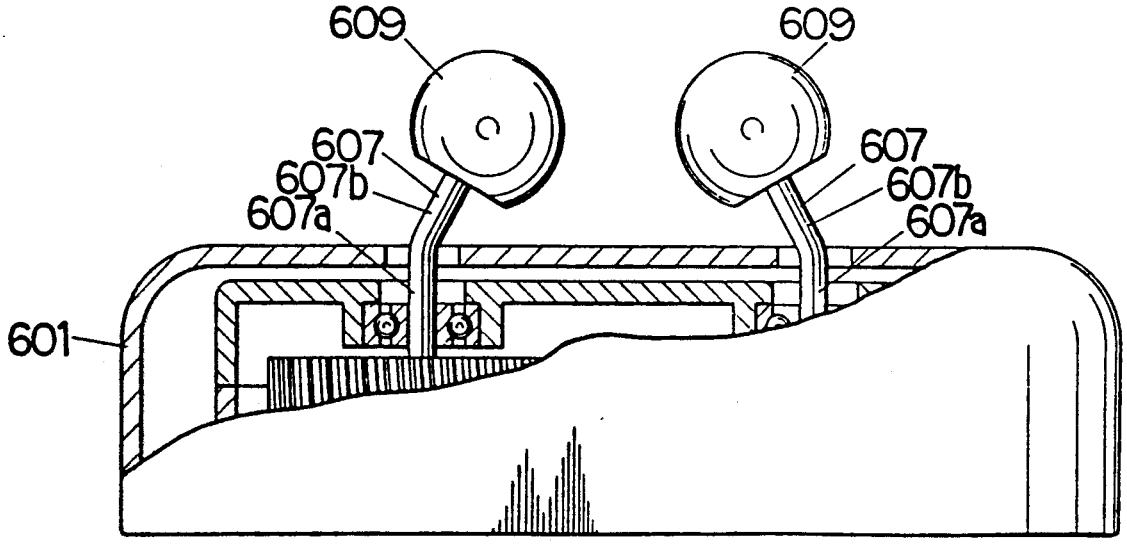

MASSAGE MACHINE

BACKGROUND OF THE INVENTION

The present invention relates to improvements in a massage machine.

In general, various massage techniques are known. These techniques include softly rubbing the skin (soft rubbing method), adding massage to the soft rubbing method by performing massage and rubbing simultaneously (strong rubbing method), massaging muscles (massaging method), adding kneading to the massage method by performing massage and kneading simultaneously (massage kneading method), striking the body (striking method), pushing while vibrating (vibrating pushing method), applying pressure to one position intermittently or continuously (pressure method), and moving each part of a body forcibly (movement method). None of the prior art massage machines, however, can apply a plurality of these techniques simultaneously, nor can they perform a massage as delicate as can be performed by hands.

An example of a prior art massage machine is shown in FIGS. 27 and 28 and has a structure in which are installed a lateral pair of rotational shafts 607, 607 each having a vertical shaft portion 607*a* and an oblique shaft portion 607*b* and being bent in a " " shape (or crank shape). The oblique shaft portion 607*b* (crank top end portion) is projected through a top plate of a housing 601, and kneading balls 609, 609 are loosely fitted to the oblique shaft portions 607*b* (crank top end portions) and can be oscillated and rotated by rotation of the rotational shafts 607, 607. More specifically, a diseased part (body part to be massaged) is grasped between the kneading balls 609, 609 and through oscillating rotation thereof, a kneading function is obtained.

SUMMARY OF THE INVENTION

An object of the invention is to provide a massage machine, wherein a kneading effect is provided by a pair of kneading balls and, simultaneously, a vibrating effect is provided by a vibration plate, and wherein a diseased part (or body portion to be massaged) is prevented from entering into a gap formed between a kneading plate and a top plate of the housing of the machine.

Another object of the invention is to provide a massage machine wherein a ball cover covering the kneading ball is detachably installed.

Still another object of the invention is to provide a massage machine wherein a motor for rotating the kneading balls is controlled by a phase control circuit, such that overgrasping between the kneading balls is prevented.

Still another object of the invention is to provide a massage machine for which, even if an excessive load is applied to the motor, the motor is not stopped.

Still another object of the invention is to provide a massage machine wherein a stop torque of the motor under an excessive load state is nearly the same irrespective of the torque setting of the motor, such that the kneading force does not become excessive when the input voltage is high.

In order to attain the foregoing objects, a massage machine of the invention is characterized in that a pair of rotational shafts in eccentric oscillating rotation are opposed to each other and projected through a top plate of a housing, kneading balls are loosely fitted to the top end of the rotational shafts, a cover piece formed on a spherical surface corresponding to the oscillating trace of the kneading ball is interposed in a gap formed between the top plate of the housing and the kneading balls so that a part of each of the kneading balls circulates around the outer circumferential surface of the cover piece, and a vibration plate is supported on the top plate through an elastic support leg.

BRIEF DESCRIPTION OF THE DRAWINGS

FIG. 1 is a perspective view of a massage machine according to the first embodiment of the invention;

FIG. 2 is a side sectional view of the massage machine;

FIG. 3 is a lateral sectional view of the massage machine;

FIG. 4 is an enlarged view of a flange mounting portion of the massage machine;

FIG. 5 is a side sectional view of a massage machine according to the second embodiment of the invention;

FIG. 6 is an exploded perspective view of the massage machine;

FIG. 7 is a side sectional view of a modified version of the massage machine according to the second embodiment;

FIG. 8 is a perspective view of a massage machine according to the third embodiment of the invention;

FIG. 9 is a side sectional view of the massage machine;

FIG. 10 is an exploded perspective view of the massage machine;

FIG. 11 is a circuit diagram of a phase control circuit;

FIG. 12 is a circuit diagram for a prior art massage machine;

FIG. 13 is a circuit diagram of a massage machine according to the fourth embodiment;

FIG. 14 is a modified version of the circuit diagram of the circuit of FIG. 13;

FIG. 15 is a circuit diagram for a prior art massage machine;

FIG. 16 is a circuit diagram of a massage machine according to the fifth embodiment;

FIGS. 27–28 show a prior art massage machine;

FIG. 27 is a perspective view of the prior art massage machine; and

FIG. 28 is a partly cutaway view of the prior art massage machine.

DESCRIPTION OF THE PREFERRED EMBODIMENTS

Figure 1:
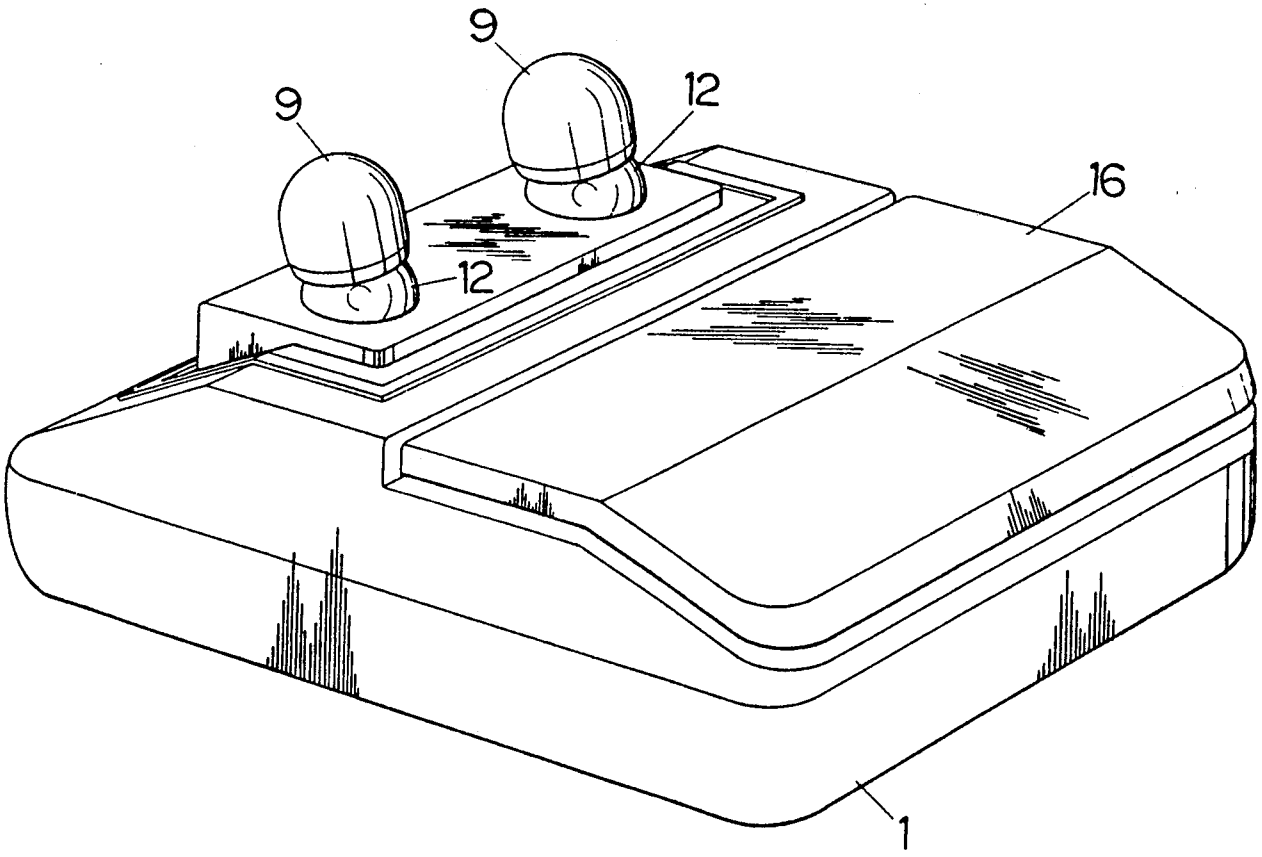
FIGS. 1–4 show a first embodiment.

Preferred embodiments of the invention will now be described referring to the accompanying drawings.

EMBODIMENT 1

As shown in FIGS. 1–4, the massage machine according to the invention includes a housing 1 which is substantially of a flat rectangular shape, and a motor 2 and a gear case 3 are mounted in opposed relation within the housing 1. Worm wheels 4, 4 are installed in the gear case 3, are fixed for rotation with a laterally spaced pair of rotational shafts 7, 7, are spaced from each other by a suitable gap (a), and are rotatable about a vertical axis. A drive shaft 5 is projected from the motor 2 towards the worm wheels 4, 4, with the free end portion of the drive shaft 5 extending into the gap (a). More specifically, a worm 6 formed on the free end portion of the drive shaft 5 meshes with both worm wheels 4, 4.

Each of the rotational shafts 7, 7 has a vertical shaft portion **7*a* and an oblique shaft portion 7*b* and is bent in a " " shape. The oblique shaft portions 7*b* are projected upwardly through holes formed in a top plate of the housing 1, and kneading balls 9 are loosely fitted to the top end portions of the oblique shaft portions 7*b*. More specifically, a bearing 10 with a flange 10' is installed on the top end portion of each of the vertical shaft portions 7*a*, and the kneading balls 9 are fitted to the bearings 10 so as to be supported by the flanges 10', and the kneading balls 9 and the flanges 10' are connected by screws 11**.

A sleeve 12 is externally installed about each of the rotational shafts 7 in the vicinity of the bent portions thereof. Each of the sleeves 12 comprises a bushing portion **12*a* vertically installed within the housing 1 about the respective vertical shaft portion 7*a*, and a taper portion 12 projected through the top plate adjacent the oblique shaft portion 7*b*. The bushing portion 12*a* is fitted to the vertical shaft portion 7*a* and formed as a long cylinder with a diameter slightly larger than that of the vertical shaft portion 7*a*. The taper portion 12*b* is fitted to the oblique shaft portion 7*b* and is formed larger at its top end than at its bottom end in a manner so as to accommodate the oscillating path of the oblique shaft portion 7*b* as the shaft 7 is rotated. A partially spherically curved cover piece 12*c* extends downwardly from the upper end edge of the taper portion 12*b*, and the lower end portion of the cover piece 12*c*** abuts against the top plate.

The kneading balls 9 are installed on the shafts 7 so that the lower end portions of the kneading balls 9 are covered by hollow portions 9' of the kneading balls 9 which open downwardly toward the bottoms of the kneading balls 9. That is, the kneading balls 9 are arranged to circulate around the outer circumferential portion of the cover piece **12*c*** while oscillating.

A vibration motor 17 is contained within the housing 1 at the opposite end portion of the machine from the shafts 7, and four elastic stays 13 are provided therein. Each elastic stay 13 is formed to enable bending deformation by interposing rubber, a spring or the like at the intermediate portion, and the upper end portion of the elastic stay 13 can be projected upwardly through a through hole 14 in the top plate. A vibration plate 16 is fixed to the upper end portion of each elastic stay 13 and spaced from the top plate by a suitable gap 15. Flanges 18, 18 are fixed to both end portions of the vibration motor 17 and extend in the horizontal direction. Vibration members 19 extend vertically from the vibration plate 16 and connect to the flanges 18. Numeral 20 designates a fan mounted on one end of the shaft of the motor 2 and opposed to the vibration motor 17, numeral 21 designates an elastic support leg fixed to the outer bottom surface of the housing 1 to prevent vibration, and numeral 22 designates a cover for covering the kneading balls 9.

Next, operation of the embodiment will be described.

The power source switch is turned on and the motor 2 is driven, thereby the driving force is transmitted through the drive shaft 5, the worm 6 and the worm wheels 4, 4 to the rotational shafts 7, 7. Since the driving force of the motor 2 is transmitted to the rotational shafts 7, 7, the pair of kneading balls 9, 9 oscillate rotatably (revolve) toward one another due to the oscillating rotation of the oblique shaft portions **7*b*, 7*b* of the rotational shafts 7, 7. When both kneading balls 9, 9 revolve, they are pressed against a diseased body part, whereby, the diseased part is pulled in the direction of revolution of both kneading balls 9, 9 due to frictional resistance produced between the diseased part and the abutting surface of the kneading balls 9, 9. When the kneading balls 9, 9 revolve such that they oscillate into a mutual opposed (or adjacent) position, they function to grasp the diseased part, such that a kneading function is obtained between the kneading balls 9, 9. Since both kneading balls 9, 9 are pressed against the diseased part and are revolved as above described, a finger-like pressure can be provided against the diseased part. That is, the kneading function and the finger-like pressure can be obtained simultaneously. In other words, the finger-like pressure can be obtained when the displacement quantity of the kneading balls 9, 9 is within the range of the play quantity of the kneading balls 9, 9** (play rotation state), such that the kneading function can be obtained when the displacement quantity exceeds the play quantity.

When the vibration motor 17 is driven, the motor 17 is vibrated through the vibration mechanism contained within the motor 17 and the vibration generated in this manner is transmitted through the flange 18 and the vibration member 19 to the vibration plate 16. In this manner, the vibration plate 16 can provide a vibrating function.

The vibration generated by the vibration motor 17 is not only transmitted to the vibration plate 16, but is also transmitted through the housing 1 to the kneading balls 9, 9. That is, both kneading balls 9, 9 are vibrated and rotatably oscillated. Since the kneading balls 9 are vibrated and rotatably oscillated as described above, the kneading function, the finger-like pressure function and the vibration function are combined to provide a complicated massage effect.

The bearings 10 with the flange 10' are installed about the rotational shafts 7 and the kneading balls 9 are connected to the flanges 10' by the threaded engagement of the screws 11, such that the elements are firmly mounted and can withstand the oscillation and vibration, and such that they can be readily attached and detached. An overload prevention mechanism can be provided, in order to guard against overload produced by the kneading balls 9, 9.

EMBODIMENT 2

This embodiment relates to an improvement in attaching and detaching a kneading ball cover.

Figure 2:
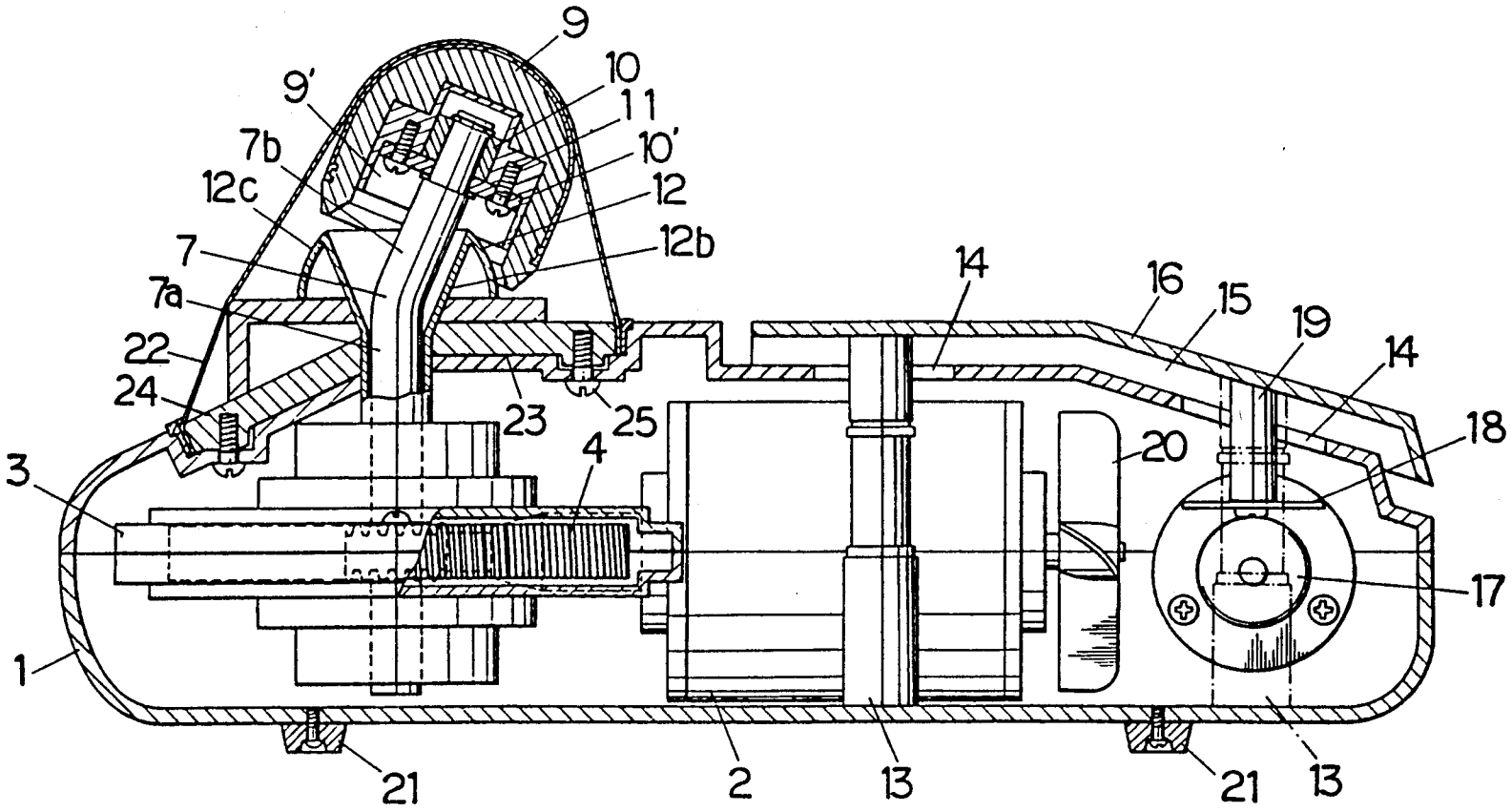
Figure 3:
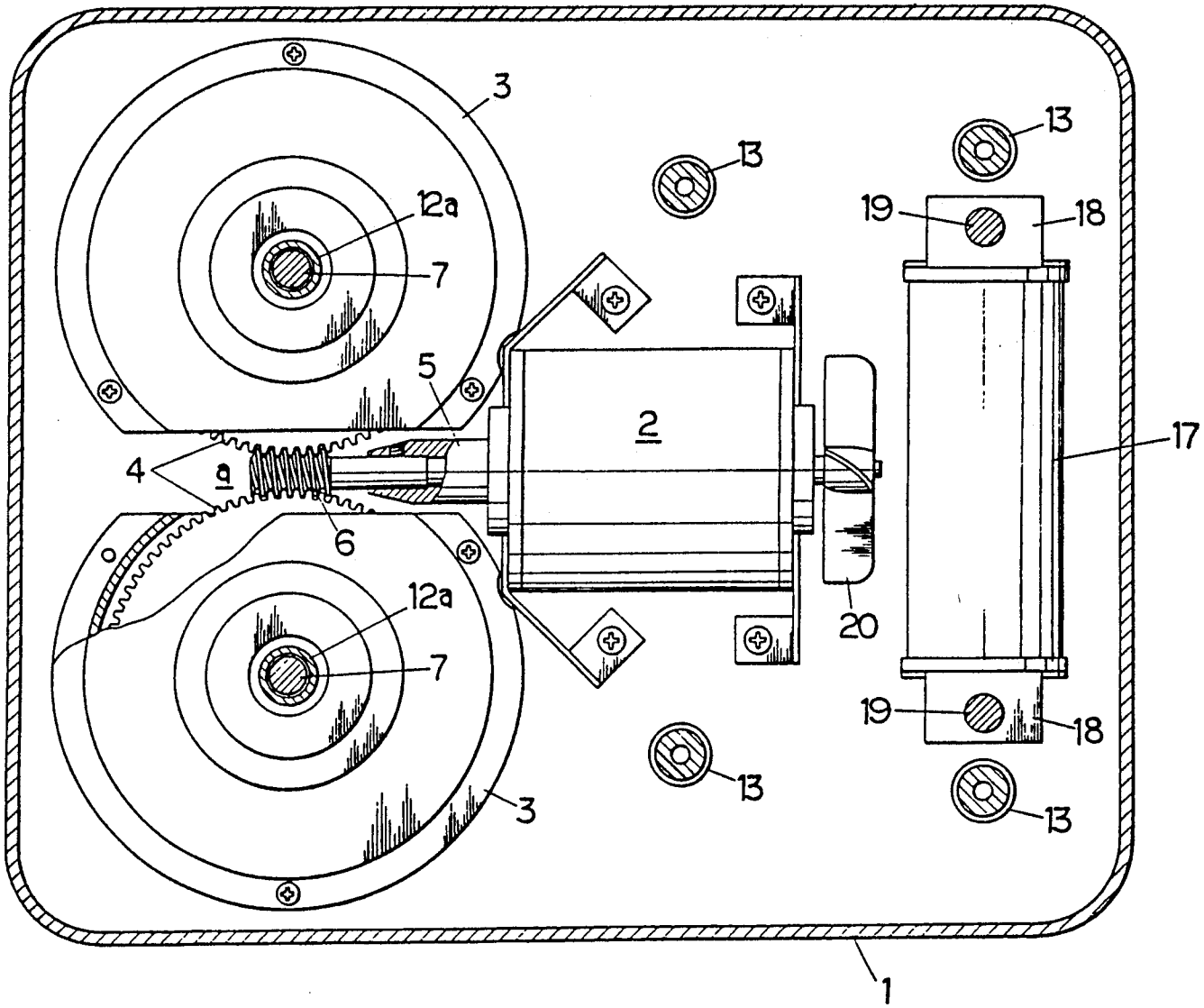
Figure 4:
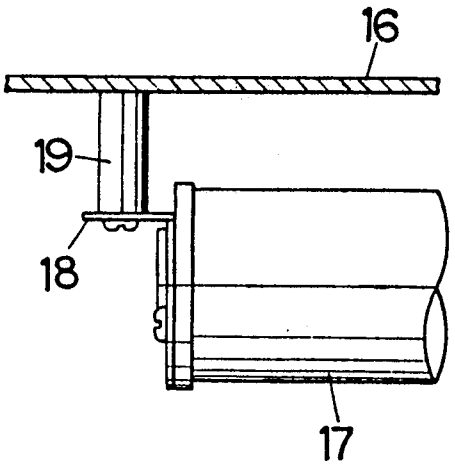

In the massage machine shown in FIGS. 1–4, the kneading ball cover 22 is usually provided between the top plate and the kneading ball. The conventional method of installing a kneading ball cover between a top plate of a housing and a kneading ball, as shown in FIG. 2, is to provide a mounting recess 23 on the top plate of the housing 1 corresponding to the kneading ball 9 such that the end portions of the kneading ball cover 22 can be grasped in the mounting recess 23 by a pushing plate 24. Fixing screws 25 are used to engage the pushing plate against the top plate of the housing 1, to thereby clamp the kneading ball cover 22 in the mounting recess 23 with pushing plate 24.

In the above-mentioned method of mounting the kneading ball cover, since the kneading ball cover is grasped between the mounting recess provided between the top plate of the housing and the pushing plate by the threaded engagement of the fixing screw, in order to exchange the kneading ball cover, the housing must be divided into two upper and lower elements and the opening end of the kneading ball cover must be grasped between the mounting recess and the pushing plate such that the fixing screws must be threadably engaged from the inside of the housing. Consequently, exchanging of the cover is very troublesome.

This embodiment intends to solve the above-mentioned problems. That is, in this embodiment, the kneading ball cover can be easily exchanged without necessitating the troublesome work of grasping the opening end of the kneading ball cover between the mounting recess and the pushing plate and the troublesome work of threadably engaging the fixing screw from the inside while the housing is divided. This embodiment is characterized in that a flange is installed in the housing side of the massage machine, and a kneading ball cover is locked to the flange through tying of a string, and a panel is detachably installed on the housing so as to enable covering of the tied portion, thereby the above-mentioned problems can be solved. The specific means are as follows:

a. A rising portion having a tying space thereabout is provided on the top plate so as to surround both vertical shaft portions, and a flange is extended outwardly from the top end portion of the rising portion.

b. A string is inserted in a passage in the opening end of the kneading ball cover. The opening end of the kneading ball cover is removably disposed in the tying space and is locked to the flange through tying of the string.

c. An engaging hole is opened through the top plate, and an engaging piece is projected from the panel which is detachably attached to the top plate through the engagement between the engaging piece and the engaging hole so as to enable covering of the tying space.

The embodiment will be described referring to FIGS. 5–7.

Figure 5:
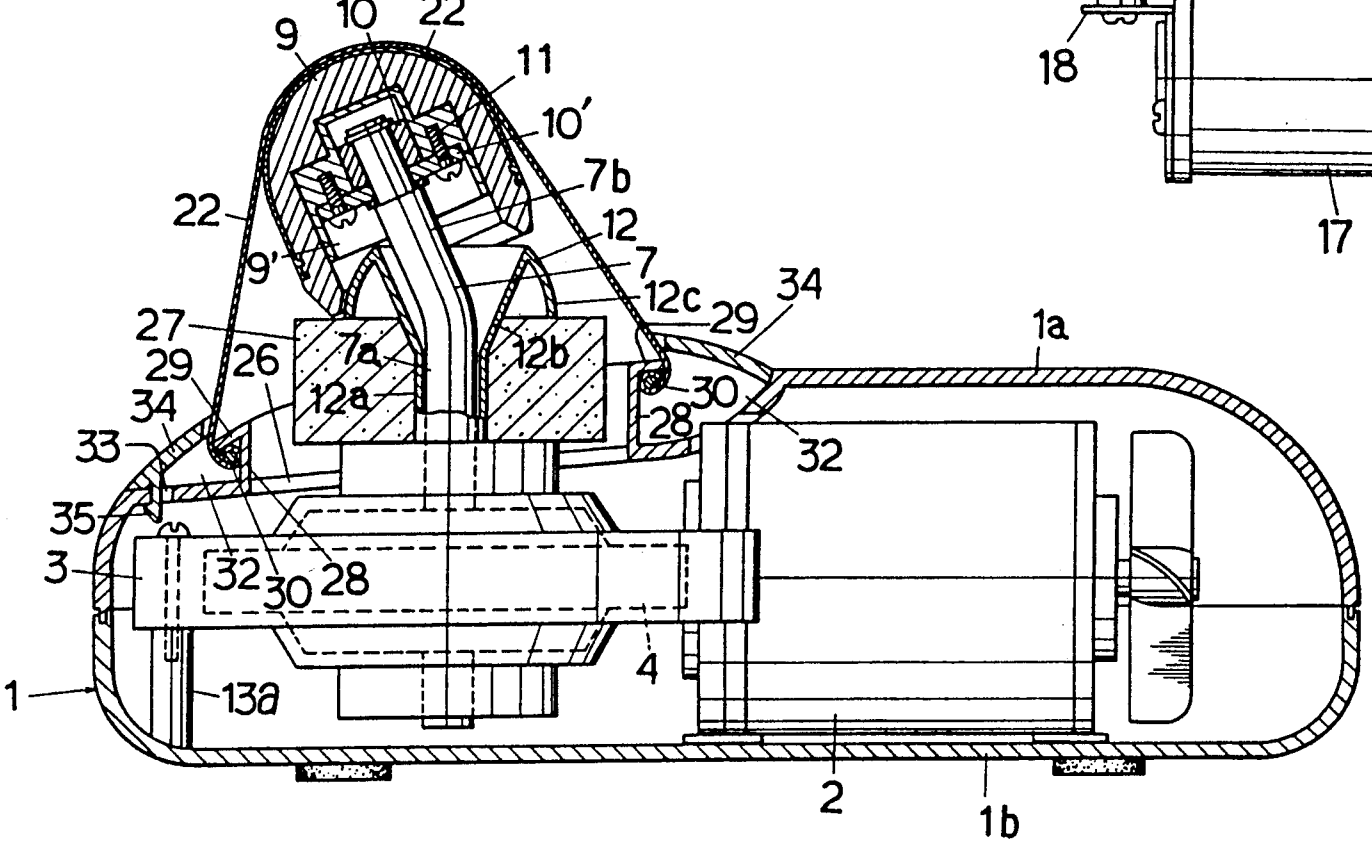
FIGS. 5–7 show a second embodiment.
Figure 6:
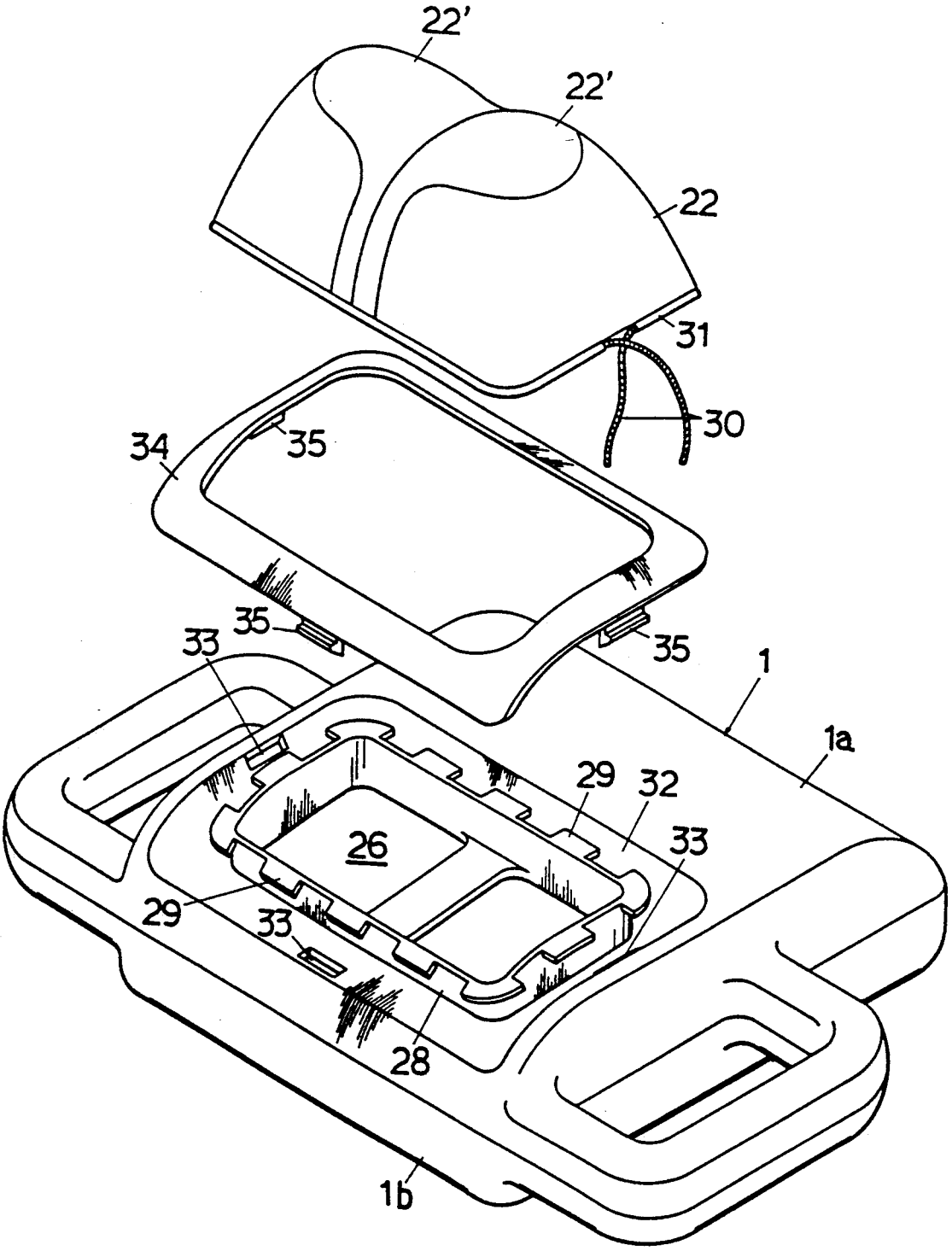

In FIGS. 5 and 6 showing the second embodiment, numeral 1 designates a housing. The housing 1 is composed of a top plate 1*a* and a bottom plate 1*b* which are of a nearly flat rectangular shape, and a motor 2 and a gear case 3 are contained within the housing 1. More specifically, a stay 13*a* is mounted to and extends upwardly from the bottom plate 1*b* at one end thereof, and one end of the gear case 3 is fixed to the upper end portion of the stay 13*a*. On the other hand, the motor 2 is opposed to the gear case 3 and is mounted on the bottom plate 1*b* at the other end thereof. Worm wheels 4, 4 are installed in the gear case 3 through a laterally spaced pair of rotational shafts 7, 7, are spaced from each other by a suitable gap, and are rotatable about vertical axes in a horizontal plane. A drive shaft (not shown) is projected from the motor 2 towards the worm wheels 4, 4, and a worm (not shown) formed on the top end portion of the drive shaft meshes with the worm wheels 4, 4.

Each of the rotational shafts 7, 7 has a vertical shaft portion 7*a* and an oblique shaft portion 7*b* and is bent in a " " shape. The oblique shaft portion 7*b* is projected upwardly through an opening portion 26 formed in the top plate 1*b* of the housing 1, and a kneading ball 9 is loosely fitted to the top end portion of the oblique shaft portion 7*b*. More specifically, a bearing 10 with a flange 10′ is installed on the top end portion of the vertical shaft portion 7*a*, and the kneading ball 9 is fitted to the bearing 10 so as to be supported by the flange 10′, and the kneading ball 9 and the flange 10′ are connected by a screw II.

A sleeve 12 is mounted about the rotational shaft 7 in the vicinity of the bent portion thereof. The sleeve 12 comprises a vertical bushing portion 12*a* mounted within the housing about the vertical shaft portion 7*a*, and a taper portion 12*b* is projected through the top plate 1*a* about the oblique shaft portion 7*b*. The bushing portion 12*a* is fitted to the vertical shaft portion 1*a* and is formed as a long cylinder with a diameter slightly larger than that of the vertical shaft portion 7*a*, and a spacer 27 is fitted about the bushing portion 12*a*. The taper portion 12 is fitted to the oblique shaft portion 7*b* and is enlarged at its upper end in order to accommodate the oscillating path of the oblique shaft portion 7*b*, the partially spherically curved cover piece 12*c* extends downwardly from the upper end portion of the taper portion 12*b*, and the lower end portion of the cover piece 12*c* abuts against the spacer 27. The kneading balls 9 are installed on the shafts 7 so that the lower end portions of the kneading balls 9 are covered by hollow portions 9′ of the kneading balls 9 which open downwardly towards the bottoms of the kneading balls 9. That is, the kneading balls 9 are arranged to circulate around the outer circumferential portion of the cover piece 12*c* while oscillating.

The top plate 1*a* of the housing 1 includes a rectangular opening 26 therein. A rising portion (or peripheral wall) 28 is provided about the periphery of the opening 26, and a plurality of flanges 29 extend outwardly at regular intervals from the upper end of the rising portion or upwardly extending peripheral wall 28. The kneading ball cover 22 is provided with a string 30 tied to the rising portion beneath the flanges 29. More specifically, the kneading ball cover 22 has spherical portions 22′, 22′ and is in mountain-like form so as to cover both kneading balls 9, 9. A bottom opening of the cover 22 has a peripheral edge which is curled to form a pipe shape which defines an inserting passage 31. The string 30 is adapted to be inserted into the inserting passage 31, such that both ends of the string 30 are exposed so that the string 31 can be tied with the kneading ball cover 22 covering both kneading balls 9, 9 and the flanges 29. The top plate 1*a* is formed to provide a sunken portion about the periphery of the rising portion 28 to define a tying space 32, and a plurality of engaging holes 33 adjacent the tying space 32. A rectangular frame panel 34 is installed above the tying space 32, and includes a plurality of downwardly projecting engaging pieces 35 adapted to detachably engage in the engaging holes 33.

Figure 7:
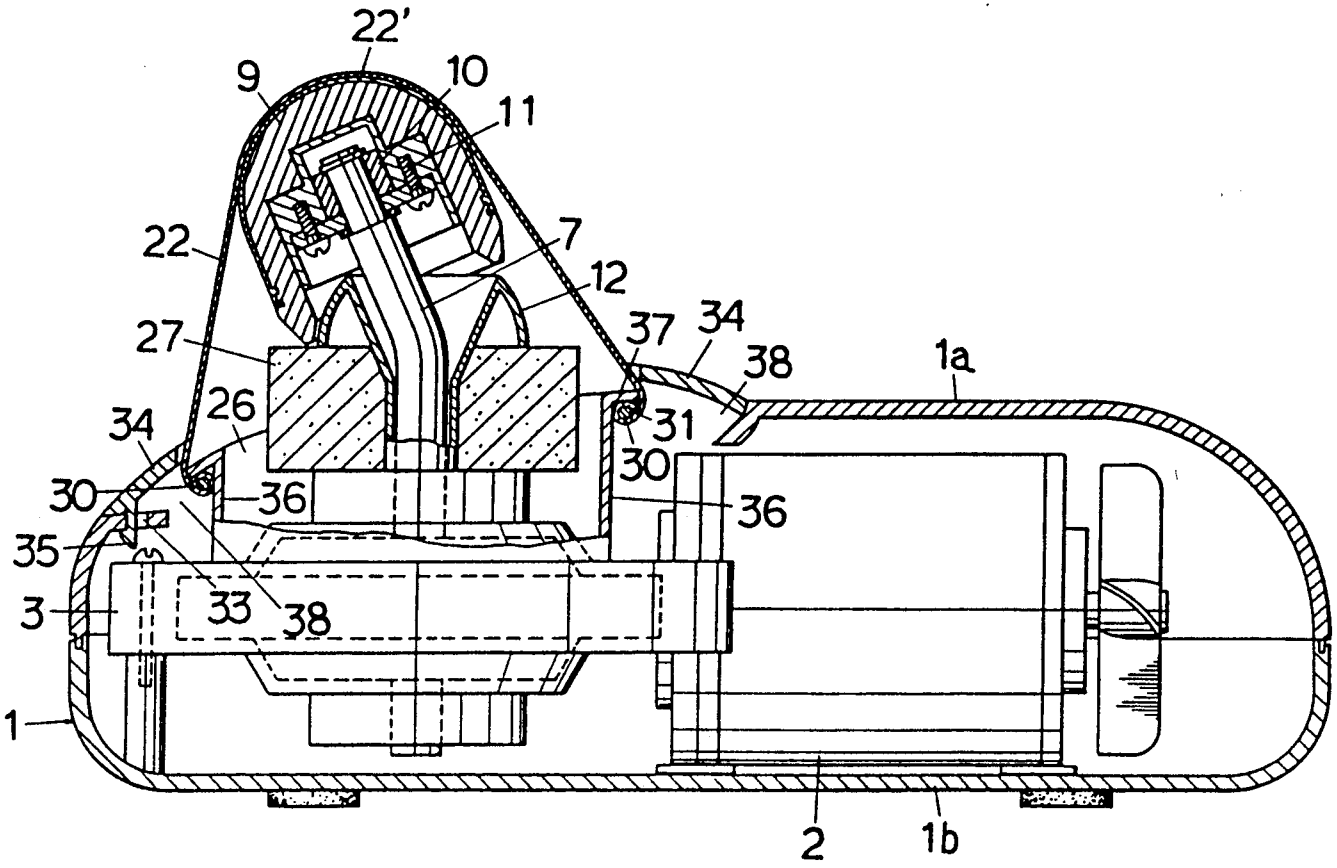
Figure 8:
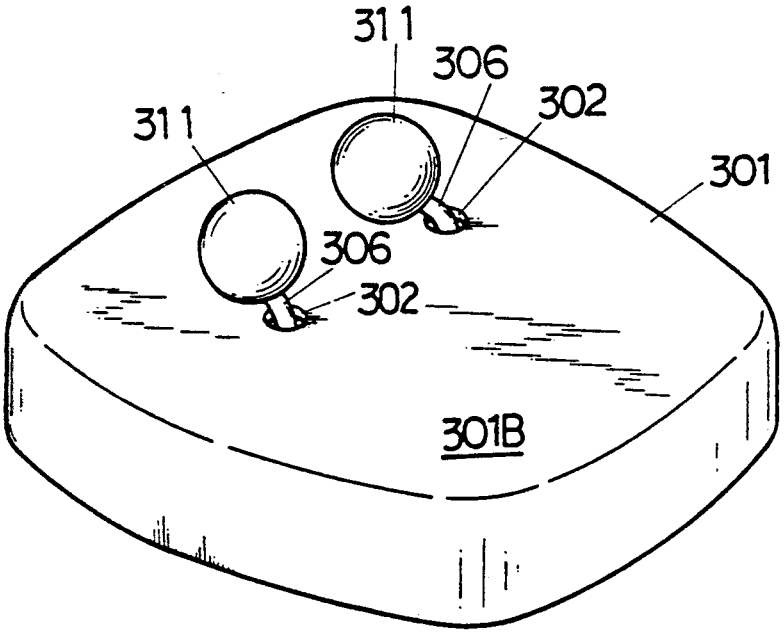
FIGS. 8–11 show a third embodiment.

FIG. 7 shows a modification of the second embodiment. In the second embodiment, the rising portion 28 extends upwardly from the top plate 1*a*, but in this modification, a rectangular shaped cylindrical rising portion 36 extends from the top surface of the gear case 3, and includes a peripheral flange 37 at the upper end portion of the rising portion 36 adapted to have the string 30 of the kneading ball cover 22 tied thereabout. A tying space 38 is defined between the top plate 1*a* and the flange 37, and the string 30 can be tied in the tying space 39. In a manner similar to the embodiment of FIG. 5, engaging holes 33' are provided in the top plate 1*a* and engaging pieces 35' are provided on the panel 34. The tying space 38 can be covered by the panel 35 by the engagement of the engaging pieces 35 in the engaging holes 33'.

Next, the method of exchanging the cover of the second embodiment will be described.

When the kneading ball cover 22 is installed on the massage machine, the kneading balls 9, 9 are covered by the spherical portions 22', 22' formed on the top portion of the kneading ball cover 22, and both end portions of the string 30 are tied while the lower end portion of the kneading ball cover 22 extends into the tying space 32, so that the bottom end of the kneading ball cover 22 can be locked to the flanges 29 through the tying of the string 30. That is, the kneading ball cover 22 can be fixed to the housing 1. When the kneading ball cover 22 is fixed to the housing 1 as described above, the engaging pieces 35 projected from the panel 34 are engaged in the engaging holes 33 formed in the housing 1, such that the panel 34 can be fixed to the housing 1, and the tying portion of the string 30 can be covered by the panel 34.

On the other hand, when the kneading ball cover 22 is detached from the massage machine, the panel 34 is detached from the housing 1 and then the string 30 is untied to release the kneading ball cover 22 from the flanges 29.

EMBODIMENT 3

This embodiment relates to an improvement to prevent overgrasping. In this embodiment, an overgrasping preventing mechanism is described using an example of a massage machine of a different type from that shown in FIGS. 1-7.

The invention is characterized in that when a lateral pair of kneading balls in oscillating rotation towards one another are rotated into mutually adjacent positions, (i.e. in which they are closest to one another), the speed of rotation of both kneading balls is temporarily decreased, i.e. both kneading balls are rotated slowly when in their mutually adjacent positions. In this manner, a diseased part can be grasped softly and overgrasping of the diseased part by both kneading balls can be prevented. In this manner, the kneading function similar to hand kneading can also be provided. The massage machine includes a pair of opposing worm wheels which are rotatable towards on another, rotational shafts connected to both worm wheels, and kneading balls loosely fitted to the top end portion of both rotational shafts. A magnet offset from the center position is fixed to either one of the worm wheels, and a lead switch is installed on a gear case covering the worm wheels at a position corresponding to the rotation trace of the magnet and is connected to a phase control circuit, such that motor can be controlled to provide low speed rotation when the pair of kneading balls pass through their mutually adjacent positions.

A third embodiment of the invention will be described with references to FIGS. 8-11.

In FIGS. 8-11, numeral 301 designates a housing which constitutes a shell of a massage machine according to the invention. The housing 301 comprises a bottom plate 301A and a cover body 301B mounted on the bottom plate 301A, and is of a flat rectangular shape. A laterally spaced pair of through holes 302, 302 are formed in a top plate of the cover body 301B, and the gear case 303 and a motor M are contained within the housing 301. Pairs of vertical bearing portions 305*a*, 305*b*, 305*a*, 305*b* are installed within the gear case 303 beneath the through holes 302, 302, and rotational shafts 306, 306 are supported by the bearing portions 305*a*, 305*b*, 305*a*, 305*b*. Each of the rotational shafts 306, 306 has a vertical shaft portion 306*a* and an oblique shaft portion 306*b* and is bent in a " " shape, and worm wheels 307, 307 are fixed to the vertical shaft portions 306*a*, 306, positioned between the vertical spaced pairs of bearing portions 305*a*, 305*b*, 305*a*, 305*b*, spaced from each other by a suitable gap "a", and rotatable in a horizontal plane.

A drive shaft 308 is projected from the motor M contained within the housing 301, and the free end portion of the drive shaft 308 is installed within the gear case 303, more specifically in the gap "a". A worm 309 is installed on the free end portion of the drive shaft 308, and meshes with both worm wheels 307, 307 in the gap "a". The oblique shaft portions 306*b*, 306*b* are projected through the through holes 302, 302 of the top plate of the cover body 301B, and kneading balls 311, 311 are loosely fitted to the top end portions of the oblique shaft portions 306*b*, 306*b* so as to cover the top end portion of the oblique shaft portions 306*b*, 306*b*. More specifically, when both oblique shaft portions 306*b*, 306*b* are rotated in opposite directions, both kneading balls 311, 311 can be simultaneously positioned at their innermost positions (i.e. mutually adjacent positions).

Figure 9:
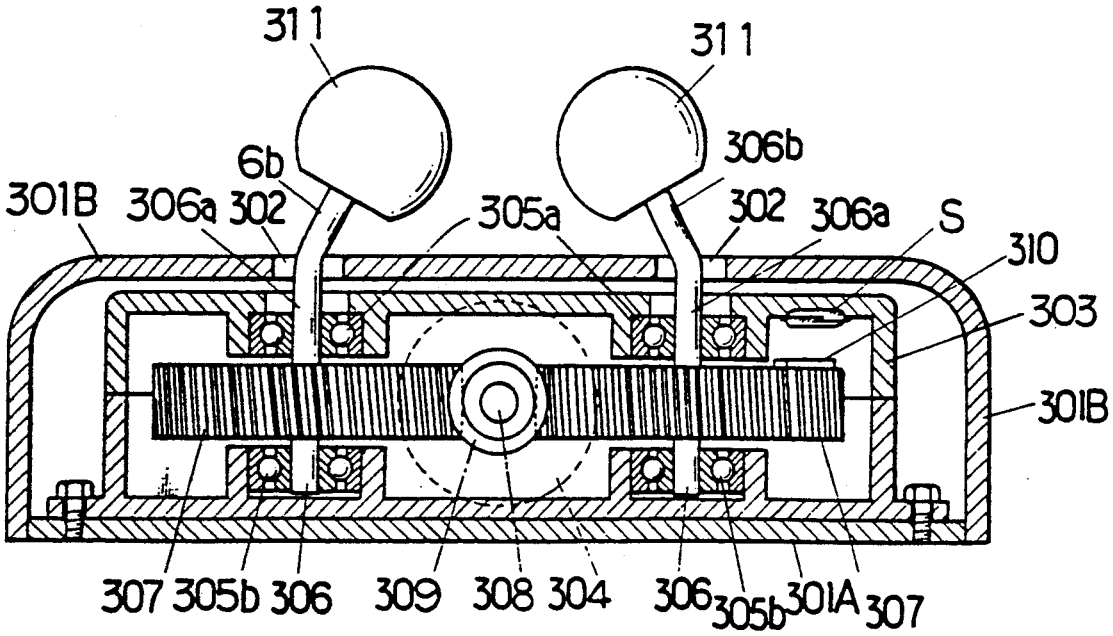
Figure 10:
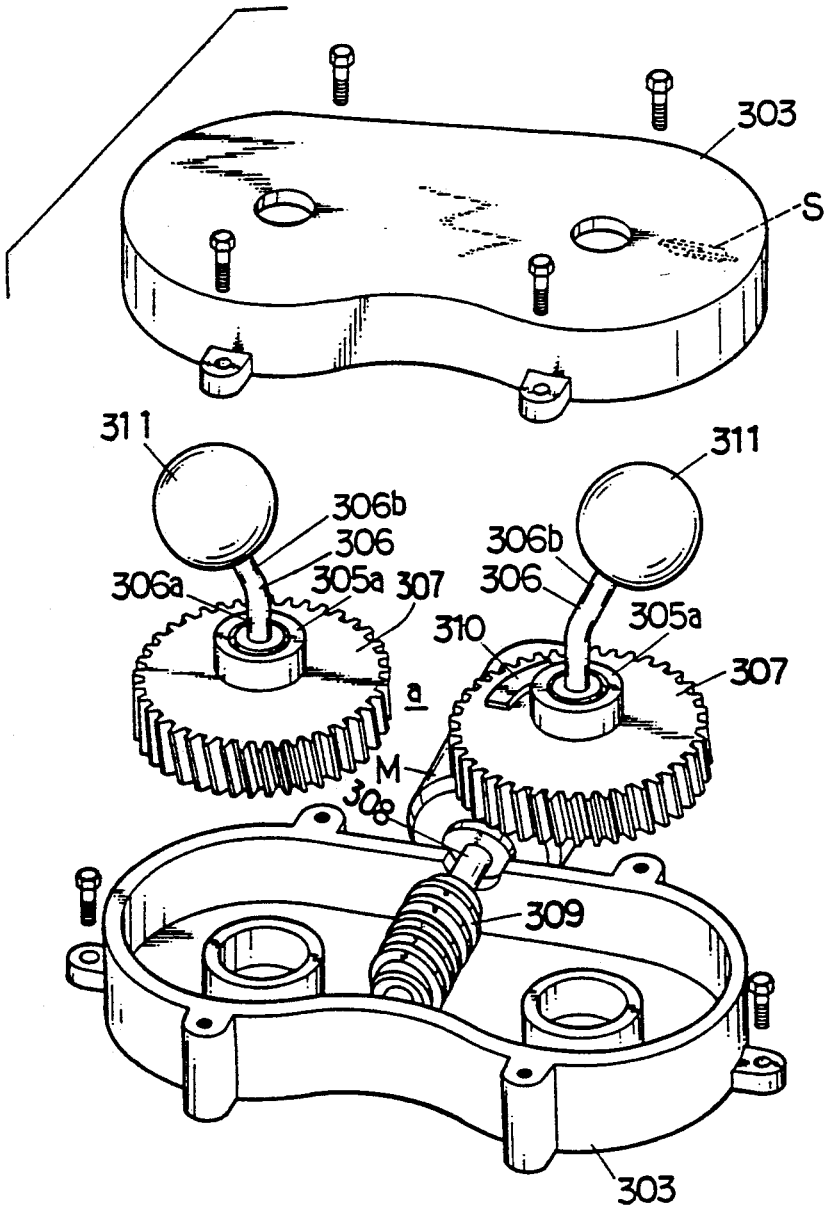
Figure 11:
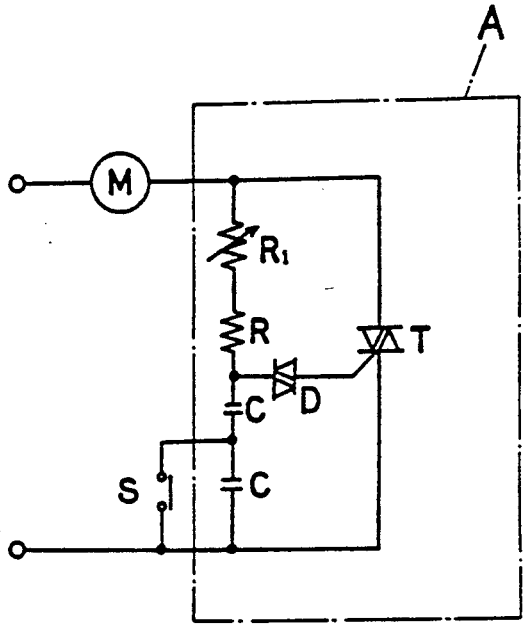

A magnet 310 is fixed to one of the worm wheels 307, 307 at the position spaced from the center position, and a lead switch S is installed on the gear case 303 at a radial position corresponding to the radial position of the magnet 310 (see FIG. 9). More specifically, the magnet 310 is mounted to the worm wheel to extend through a predetermined circumferential angle and is positioned slightly ahead of the circumferential position of the kneading ball 311. Also, the lead switch S is installed at a circumferential position slightly behind the circumferential position of the kneading balls 311, 311, such that when the kneading balls 311, 311 are approaching their mutually adjacent state, the magnet 310 approaches alignment with the lead switch S. The lead switch S is connected to a phase control circuit A. The phase control circuit A, as shown in FIG. 11, is composed of a triac T, a trigger diode D, a semi-fixed resistor R1, a resistor R and a capacitor C, and is operatively connected to the motor M.

Next, operation of the embodiment will be described.

The power source switch is turned on and the motor M is driven, such that a driving force is transmitted through the drive shaft 308, the worm 309 and the worm wheels 307, 307 to the rotational shafts 306, 306. Since the driving force of the motor M is transmitted to the rotational shafts 306, 306, the pair of kneading balls 311, 311 rotatably oscillate toward one another (i.e. the kneading balls 311, 311 revolve in opposing directions toward each other) due to the rotation of the oblique shaft portions 306*b*, 306*b* of the rotational shafts 306, 306. When both kneading balls 311, 311 are oscillating (revolving) toward one another, they are pressed against a diseased body part such that the diseased part is pulled in the rotation direction of the kneading balls 311, 311 through frictional resistance produced between the diseased part and the abutting surface of the kneading balls 311, 311. When the kneading balls 311, 311 are rotated into their mutually adjacent positions, as shown in FIG. 9, the diseased part is grasped, i.e., kneaded between the kneading balls 311, 311. In the invention, since the magnet 310 is fixed to the worm wheel 307 and the lead switch S is installed on the gear case 303 at the location corresponding to the magnet 310 as described above, when the kneading balls 311, 311 approach their mutually adjacent positions, the lead switch S and the magnet 310 re aligned with each other, such that the lead switch S is turned on by the magnetic force of the magnet 310. When this occurs, the input to the motor M, is reduced by the phase control circuit A, such that the motor speed is reduced. Since both kneading balls 311, 311, when in their mutually adjacent positions, are rotated slower than usual as described above, the diseased part can be grasped softly. When the kneading balls 311, 311 pass through their mutually adjacent positions, the speed is varied only temporarily, such that a varied pushing force can be applied to the diseased part kneading function similar to that attainable by hand kneading.

Although the rotational shafts 306, 306 are bent in a " " shape such that the oscillating type rotation of the kneading balls 311, 311 can be obtained in the embodiment, the rotational shafts 306, 306 may be bent in a crank shape in order to cause the kneading balls 311, 311 to be rotated in oscillating type rotation.

EMBODIMENT 4

This embodiment relates to an improvement wherein rotation of a motor is controlled by a phase control circuit such that, even when excessive load is applied to the motor, the rotation thereof is not stopped.

Figure 12:
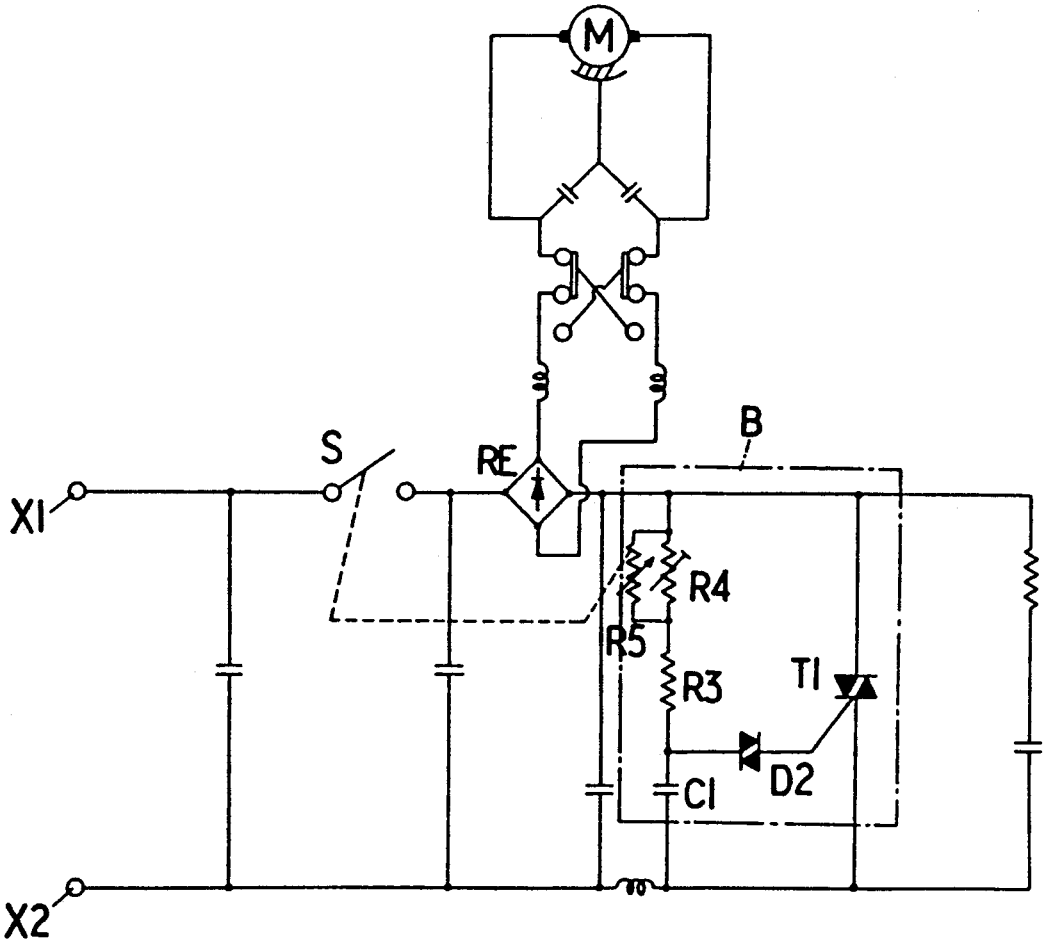
FIGS. 12–14 illustrate a fourth embodiment.

In general, in a hand type massage machine, for example, a rolling massage machine, a drive shaft is meshed with a motor shaft of a DC motor and is installed laterally, and a plurality of support shafts are arranged at regular circumferential intervals about the drive shaft and are installed laterally. A roller is loosely installed on each support shaft, and each support shaft is rotated for revolution about the drive shaft and each roller is freely rotated, so as to provide the massage function. In the massage machine using the DC motor in this manner, one proposed method of providing variation in the intensity of the massage has been to connect a bridge rectifier circuit to the AC power source and to connect a motor to the bridge rectifier circuit such that the motor is driven in accordance with the rectifying function of the bridge rectifier circuit, and the rotational speed of the motor is controlled by controlling the voltage with the phase control circuit (refer to Japanese utility model application 121421/1986). FIG. 12 is a circuit diagram of a specific example of such circuit. In FIG. 12, a bridge rectifier circuit RE is connected between AC input terminals X1, X2, a phase control circuit B is connected to the input side of the bridge rectifier circuit RE, and a motor M is connected to the output side of the bridge rectifier circuit RE. A variable resister R5 of the phase control circuit B is varied such that the conduction angle of a triac T1 is varied through a trigger diode D2, in order to control the input voltage of the motor M.

In the massage machine in the prior art as described above, however, when the variable resistance is increased and the rotational speed of the motor is set slow (when the control level of the massage machine is set to "weak"), low input voltage is applied to the motor through the phase control, such that the torque of the motor becomes weak and when excessive load is produced the motor is stopped.

This embodiment intends to solve the above-mentioned problems so that when the motor control level is set to "weak" the motor to which the excessive load is applied is not stopped. That is, in this embodiment, a photo sensor is utilized, a light emission element to detect the excessive load is installed to the motor side, and a light receiving element is installed to the side of the phase control circuit. When an excessive load is applied, both ends of the variable resistor are short circuited through the light receiving element and the conduction angle is widened, such that the input voltage of the motor is raised and the torque is increased. The specific means and function of this embodiment are as follows.

In a massage machine wherein a rectifier circuit is connected to the AC power source and a motor is connected to the rectifier circuit, and the motor is connected by a phase control circuit:

a. A resistor is connected in series between the motor and the rectifier circuit, and a light emission element is connected in parallel to the resistor.

b. A light receiving element is arranged in opposition to the light emission element, and is connected in parallel to a variable resistor for controlling the conduction angle to constitute the phase control circuit.

When the variable resistor is set large and an excessive load is applied to the motor, the armature current becomes large and a potential is produced between the ends of the resistor, such that the light emission element irradiates light. When the light emission element irradiates light in this manner, the light receiving element detects the light and becomes conductive. That is, both ends of the variable resistor are short circuited electrically by the light receiving element. Since the short circuit can be obtained as described above, it follows that the conduction angle is widened in the phase control circuit and the motor is operated at a high input voltage and the torque is raised.

The embodiment will be described with reference to FIGS. 13–14.

Figure 13:
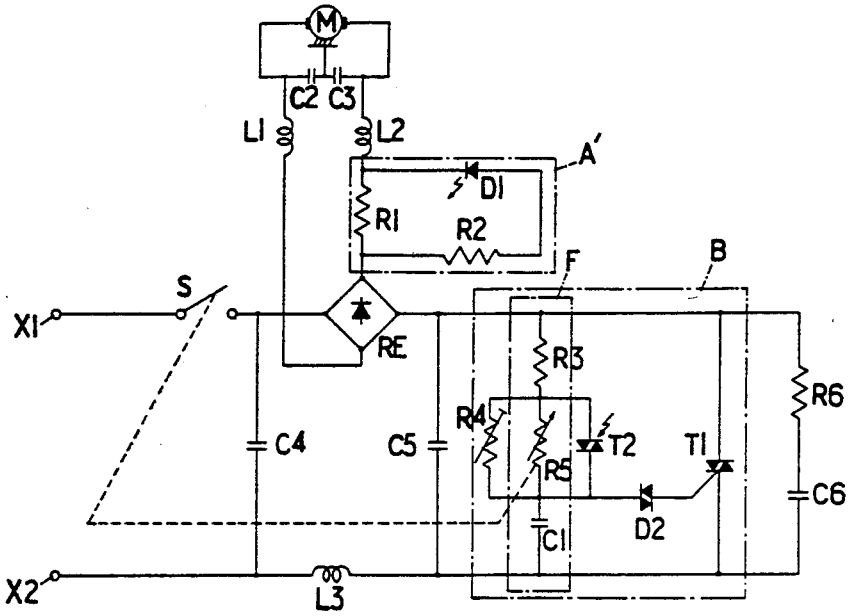

In FIG. 13, which illustrates the fourth embodiment, numerals X1, X2 designate AC input terminals. A switch S is connected in series to the AC input terminal X1, the input side of a bridge rectifier circuit RE is connected to the switch S, and a motor M is connected to the output side of the bridge rectifier circuit RE through a light emission circuit A. The light emission circuit A comprises a resistor R1 for generating the potential which is connected to the output side of the bridge rectifier circuit RE, a light emission diode (light emission element) D1 is connected in parallel to both ends of the resistor R1, and a resistor R2 for regulating the operation voltage of the light emission diode D1 is connected in series with the diode D1.

On the other hand, a phase control circuit B is connected between another input side of the bridge rectifier circuit RE and the AC input terminal X2. In the phase control circuit B, R3 designates a resistor, R4 designates a semi-fixed resistor, R5 designates a variable resistor for controlling the conduction angle, C1 designates a capacitor, D2 designates a trigger diode (diac), and T1 designates a triac whose conduction angle is controlled by the variable resistor R5. The variable resistor R5 is connected so that it can be interlocked with the switch S. A photo triac (light receiving element) T2 is connected in parallel between both ends of the variable resistor R5 and is opposed to the light emission diode D1.

A capacitor C4 and a coil L3 are installed so as to reduce noise due to the phase control. A resistor R6 and a capacitor C6 are installed so as to prevent improper triggering. F designates a time constant circuit (phase shifter) installed to shift the phase corresponding to the time constant CR.

Figure 14:
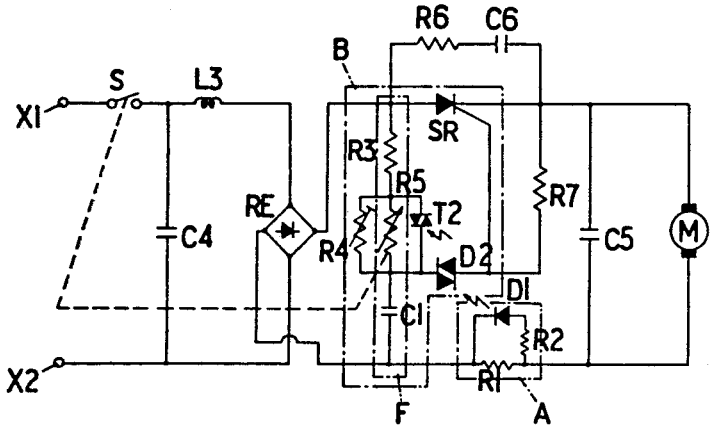

FIG. 14 is a circuit diagram showing a modification of the fourth embodiment. In FIG. 14, the input side of a bridge rectifier circuit RE is connected between AC input terminals X1, X2 through a switch S. A phase control circuit B is connected to the output side of the bridge rectifier circuit RE, and also a motor M and a light emission circuit A' are connected thereto respectively in a manner similar to the fourth embodiment. in the phase control circuit B, since DC current rectified by the rectifier circuit RE flows, a thyristor (SCR) SR is used in place of the triac T1.

Next, the operation will be described.

In the fourth embodiment shown in FIG. 13, when the variable resistor R5 is set to a high resistance (when the control level of the massage machine is set to "weak") through the operation of the switch S, the triac T1 is triggered by the charging and discharging of the capacitor C1 through the trigger diode D2, and the conduction angle of the triac T1 is narrowed. Since the conduction angle of the triac T1 is narrowed in this manner, a low input voltage is impressed to the motor M. Since the low input voltage is impressed to the motor M in this manner, the motor M is operated with a small torque and low rotational speed. When the motor M is operated at the small torque and an excessive load is applied thereto, the armature current of the motor M becomes large. When the armature current becomes large, a potential is produced between the ends of the resistor R1, and the light emission diode (light emission element) D1 irradiates light. Since the light emission diode D1 irradiates light in this manner, the photo triac (light receiving element) T2 detects the light emission state and is rendered conductive (ON state). That is, both ends of the variable resistor R5 are short circuited electrically through the photo triac (light receiving element) T2, and the conduction angle is widened in the triac T1. Since the conduction angle is widened in the triac T1, it follows that the motor M is operated at high input voltage. That is, torque of the motor M ca be raised.

The modification shown in FIG. 14 is different from the fourth embodiment in that direct current flows through the phase control circuit B by the rectifying operation of the bridge rectifier circuit RE, but is nearly equivalent to the fourth embodiment with respect to its function. That is, variation of the armature current upon application of an excessive load is detected by the light emission circuit A', and the photo triac (light receiving element) T2 is operated and short circuited through the light emission function of the light emission diode (light emission element) D1 in the light emission circuit A'. Consequently, the conduction angle of the thyristor (SCR) SR is varied and the voltage of the motor M is controlled, such that the input voltage of the motor M is raised and the motor M is prevented from being stopped.

In the light emission circuit A', the resistances of resistors R1, R2 are suitably set so that the operating point of the light emission circuit A' can be freely set. In the modification, although a photo triac T2 with bidirectional properties is used as a light emission element, in place of this, a photo thyristor with monodirectional properties may, of course, be used.

As described above, in a massage machine wherein a rectifier circuit is connected between AC input terminals and a motor is connected to the rectifier circuit and controlled by a phase control circuit, when a resistor is connected in series between the motor and the rectifier circuit, a light emission element is connected in parallel with the resistor, and a light receiving element is connected in parallel with a variable resistor of the phase control circuit and is opposed to the light emission element such that the motor control level is set low, if excessive load is applied, both ends of the variable resistor are short circuited by the photo sensors (light emission element, light receiving element), the conduction angle of the phase control circuit is widened, and the input voltage of the motor is raised, such that the motor under excessive load is not stopped. Since the motor is not stopped when under an excessive load, the massage machine is easier to use.

EMBODIMENT 5

This embodiment relates to an improvement for preventing variation of the stop torque of a motor so as to prevent danger to a human body when excessive load is applied to a kneading ball.

Figure 15:
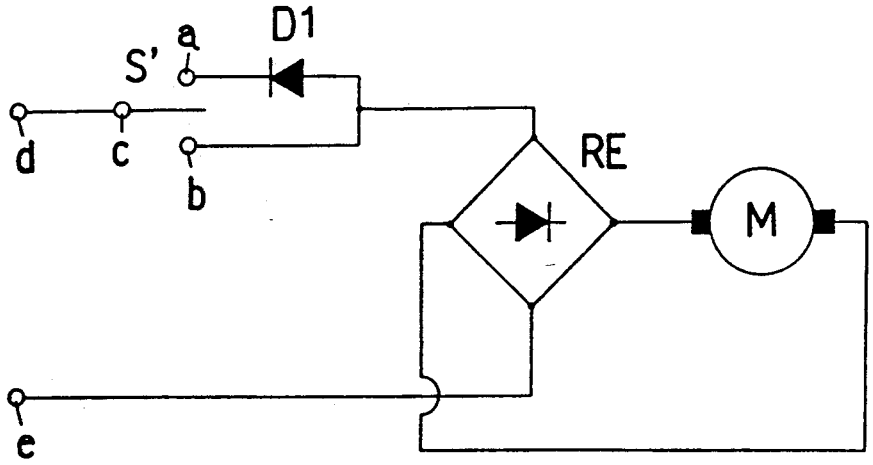
FIGS. 15–16 illustrate a fifth embodiment.
Figure 16:
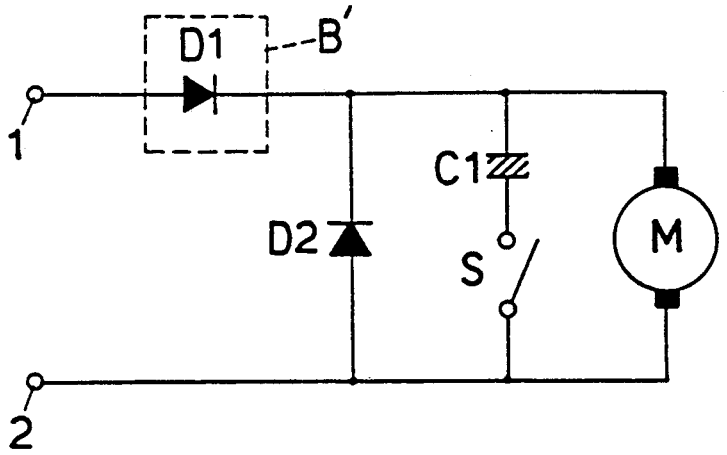

In general, in a massage machine which mainly performs a kneading function, a rotational shaft being oscillated due to rotation with its top end portion shifted from the rotational center is projected through a top plate of a housing and a kneading ball is loosely fitted to the top end portion of the rotational shaft. Also, an output shaft of a motor is connected to the rotational shaft and the kneading ball is oscillated due to rotation of the motor, so as to provide a massage effect. A method of providing a kneading function with varied intensity has been proposed by varying the input voltage to the motor by changing between full-wave rectification and half-wave rectification. FIG. 15 shows this specific circuit. In the circuit, a change-over switch S' is constituted by terminals a, b and a common terminal c, and one AC input terminal d is connected to the common terminal c. The terminal a is connected to a diode $D_1$ for half-wave rectification, the diode $D_1$ is connected to one input side of a bridge rectifier circuit RE, and the terminal b and the bridge rectifier circuit RE are connected in parallel to the diode $D_1$. Another AC input terminal e is connected to another input side of the bridge rectifier circuit RE. A motor M is connected to the output side of the bridge rectifier circuit RE so that the level of the input voltage to the motor M can be set by changing of the change-over switch S'. That is, when the change-over switch s'' is changed to the side of the terminal a, the AC input voltage is rectified in half wave by the diode D1 and a low input voltage is impressed to the motor M, and when the change-over switch S' is changed to the side of the terminal b, the AC input voltage is rectified in full wave by the bridge rectifier circuit RE and a high input voltage is impressed to the motor M.

In the above-mentioned prior art massage machine, however, since variation of the level of the input voltage to the motor is obtained by only changing between full-wave rectification and half-wave rectification, the stop torque of the motor is also varied. That is, when the input voltage is high, the stop torque becomes large, and when the input voltage is low the stop torque becomes small. Since the stop torque of the motor is varied corresponding to the amount of the input voltage to the motor as described above, problems exist in that the kneading force of the kneading ball is varied in dependence on the level of the input voltage to the motor. In other words, if the torque of the motor is set corresponding to a high input voltage to the motor, the kneading ball is stopped even by a small load and the kneading force is deteriorated when the input voltage is low, whereas if the torque of the motor is set corresponding to a low input voltage to the motor, the kneading force of the kneading ball becomes excessive, and the human body may be subject to danger when the input voltage is high.

This embodiment is intended to solve the above-mentioned problems by preventing variation of the stop torque of a motor in dependence on the level of the input voltage to the motor and by preventing danger to the user of the massage machine when an excessive load is applied. That is, the embodiment is characterized in that, in place of changing the level of the input voltage to the motor by a change-over switch as in the prior art, a capacitor is installed within the circuit and the level of the input voltage is set through the charging and discharging function of the capacitor, such that under an excessive load, the stop torque of the motor is substantially unchanged irrespective of the level setting of the input voltage to the motor. The specific means and function are as follows:

a. A pulsating waveform generating circuit is provided to generate rectified waves with a definite period by impressing the AC voltage.

b. A motor is connected to the AC power source through the pulsating waveform generating circuit, a capacitor is connected in parallel to the motor, and a switch is connected in series with the capacitor.

When the switch is opened, rectified waves generated with a definite period by the pulsating waveform generating circuit are impressed upon the motor which is operated at a low input voltage. When the switch is closed, a potential due to charging and discharging of the capacitor is added to the rectified wave and is then impressed upon the motor which is operated at a high input voltage. In this case, if an excessive load is applied, the potential due to the charging and discharging function of the capacitor is rapidly decreased and the stop torque of the motor becomes nearly the same as when the switch is open.

This embodiment will be described with reference to the accompanying drawings.

In FIGS. 16 through 20 which illustrate the fifth embodiment, numerals X1, X2 designate AC input terminals. A pulsating waveform generating circuit B′ to generate rectified waves rising in mountain-like shape with a definite period, and a DC motor M, are connected in series between both AC input terminals X1, X2.

The pulsating waveform generating circuit B′ is constituted by a diode (half-wave rectifier circuit) D1, and performs half-wave rectification of the AC input voltage through a rectifying function of the diode D1, and can obtain pulsating waveform (hand-wave rectified sinusoidal wave) to drive the motor M. An electrolytic capacitor C1 is connected in parallel with the motor M, and the potential due to the charging and discharging function of the electrolytic capacitor C1 is added to the potential of the half-wave rectification by the diode D1, in order to set the level of the input voltage to the motor. A switch S is connected in series with the electrolytic capacitor C1, and through switching of the switch S, changing of the level setting of the input voltage in the motor M, i.e., changing between "strong" and "weak" modes, can be effected. Also D2 designates a diode for inhibiting the counter electromotive force of the motor M. In FIGS. 21 through 26, which illustrate a modification of the fifth embodiment, a pulsating waveform generating circuit is connected between the AC input terminals X1, X2 to generate a rectified wave rising with a mountain-like shape and with a definite period.

In FIGS. 21 through 26, which illustrate a modification of the fifth embodiment, a pulsating waveform generating circuit B″ is connected between the AC input terminals X1, X2 to generate a rectified wave rising with a mountain-like shape and with a definite period.

The pulsating waveform generating circuit B″ is constituted by a phase control circuit A″ and a bridge rectifier circuit RE, varies the AC input voltage through voltage control of the phase control circuit A″, performs full-wave rectification thereof through rectifying function of the bridge rectifier circuit RE, and can obtain pulsating waveform (full-wave rectification partial sinusoidal wave: that having full-wave rectification sinusoidal wave by the conduction angle in the phase control circuit A″) to drive the motor M. More specifically, one input side of the bridge rectifier circuit RE is connected to the AC input terminal X1, and the AC input terminal X2 is connected to another input side of the bridge rectifier circuit RE through the phase control circuit A″. In the phase control circuit A″, VR designates a variable resistor (volume) for controlling the conduction angle, R1 designates a resistor, and C2 designates a capacitor. These elements together define a phase shifter. DT designates a trigger diode (diac), and T designates a triac whose conduction angle is controlled by the variable resistor VR. A resistor R2 and a capacitor C3 for preventing misstriggering of the trigger diode DT are connected in parallel to the triac T.

On the other hand, a motor M is connected to an output side of the bridge rectifier circuit RE, a capacitor C1 is connected in parallel with the motor M, and a switch S is connected in series to the capacitor C1 in a manner similar to the fifth embodiment.

Next, the operation will be described.

Figure 17:
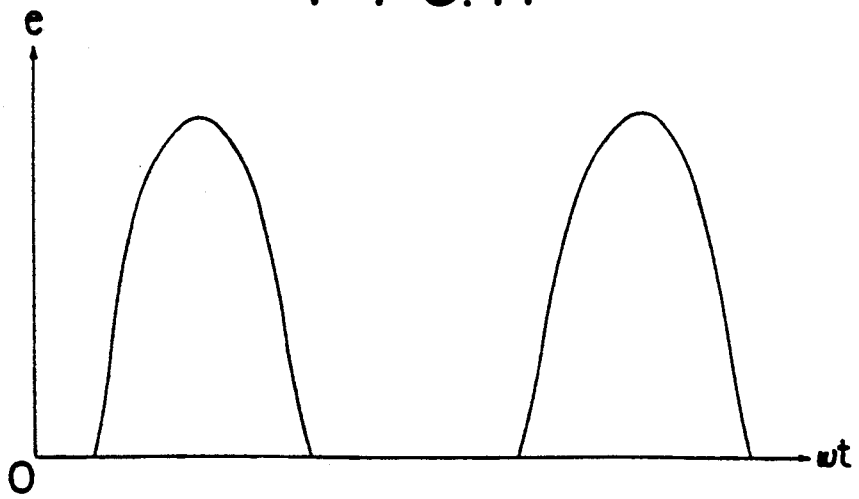
FIGS. 17–20 are diagrams illustrating waveforms of a motor input voltage for the massage machine of the invention.

In the fifth embodiment shown in FIGS. 16 through 20, the massage machine is set in a "weak" mode through operation of the switch S whereby the switch S is opened. When the switch S is opened and the AC input voltage is impressed from both AC input terminals X1, X2 to the circuit, the AC input voltage is rectified in half wave by the pulsating waveform generating circuit B″ (diode D1) and becomes a pulsating waveform rising in a mountain-like shape with a definite period as shown in FIG. 17 (half-wave rectification sinusoidal wave), and is impressed to the motor M. Since the input voltage of such pulsating waveform is impressed to the motor M, the motor M is operated at low voltage.

Figure 18:
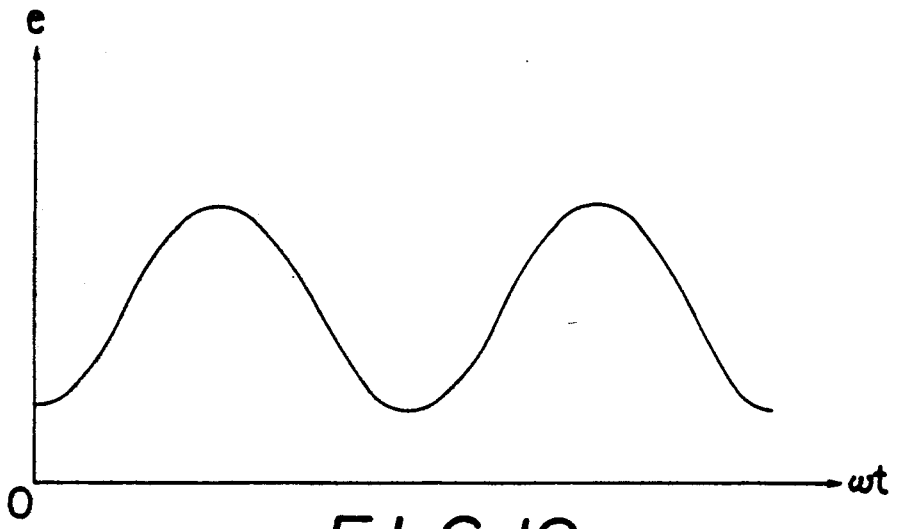
Figure 19:
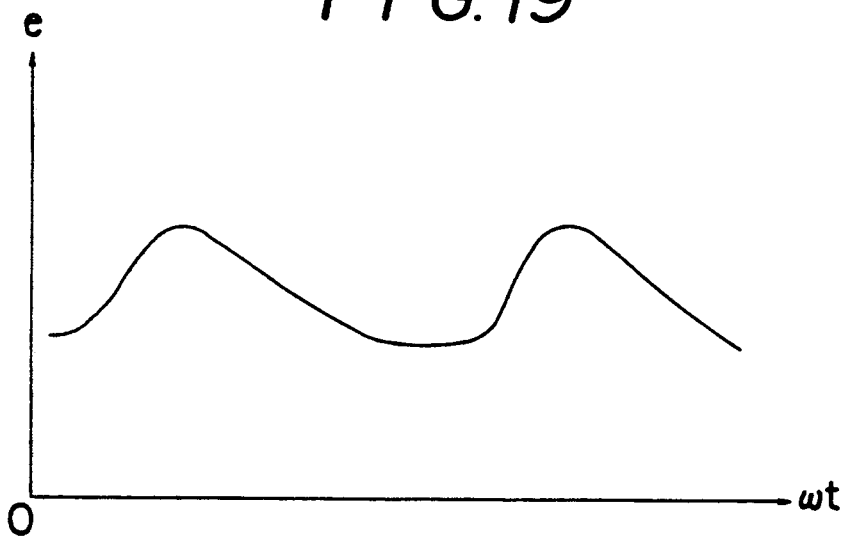

On the other hand, the massage machine can be set in a "strong" mode through operation of the switch S whereby the switch S is closed. When the switch S is closed in this manner, a charging and discharging function is obtained in the electrolytic capacitor C and potential by the charging and discharging function of the electrolytic capacitor C is added to the potential of half-wave rectification by the diode D1, such that a high input voltage waveform, as shown in FIG. 18, can be obtained when the motor M is in a no load state. That is, the high input voltage is impressed to the motor M which is rotated at a high torque. When the high input voltage is impressed to the motor M and normal load is applied to the motor M, the input voltage is slightly decreased as shown in FIG. 19, but the motor M can be rotated sufficiently to act as a massage machine.

Figure 20:
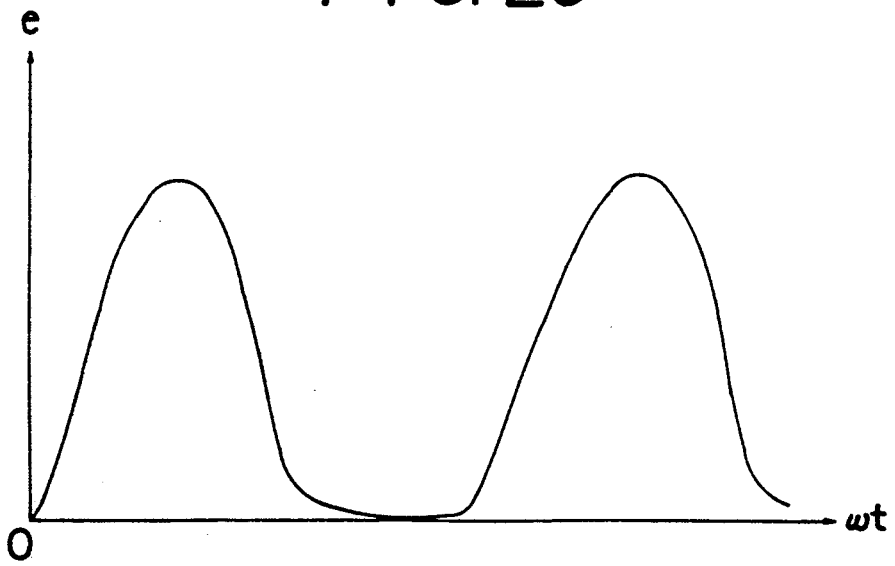
Figure 21:
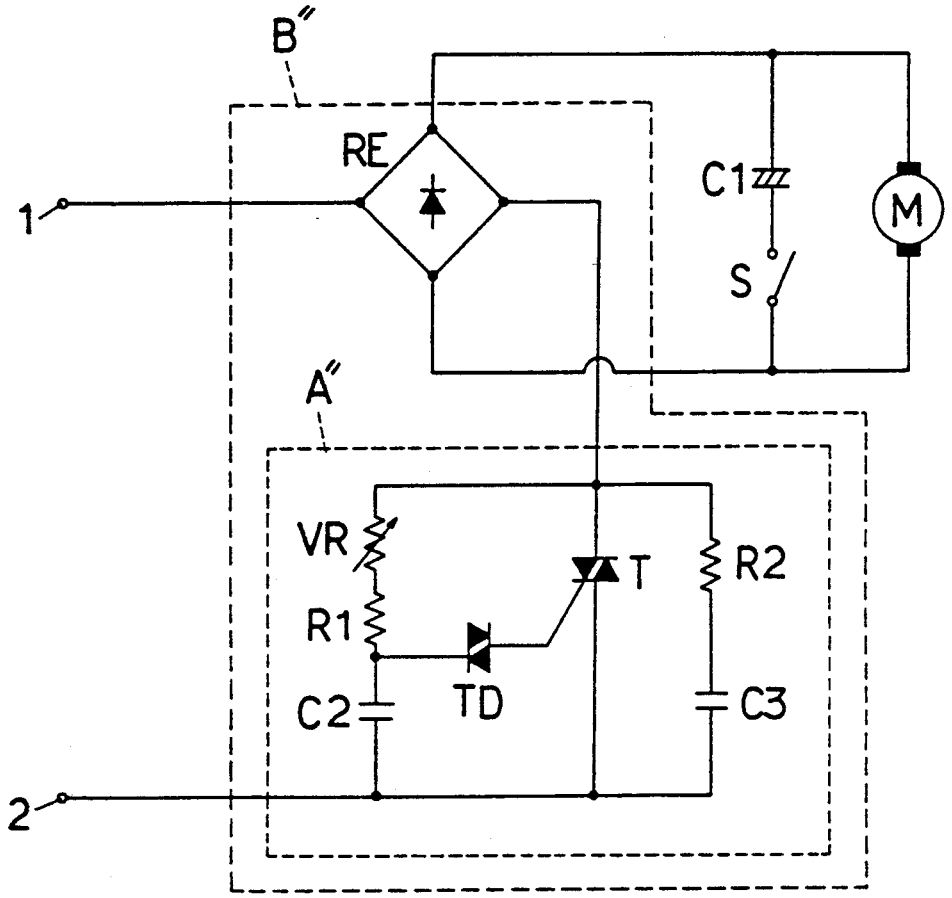
FIG. 21 is a modified version of the circuit diagram of FIG. 16.

If excessive force is applied to the kneading balls of the massage machine, a large current flows through the motor M and the potential due to the charging and discharging of the electrolytic capacitor C is rapidly decreased. Since the potential due to the charging and discharging of the electrolytic capacitor C is rapidly decreased in this manner, as shown in FIG. 20, the input voltage waveform of the motor M becomes nearly equivalent to the half-wave rectified waveform shown in FIG. 17. That is, if an excessive load is applied to the kneading balls of the massage machine, irrespective of the level setting of the input voltage to the motor M (i.e. of whether the switch S is set to "strong" or "weak", the input voltage of the motor M becomes nearly equivalent to that when set in the "weak" mode, such that the human body is not subject to danger when an excessive load is applied.

Figure 22:
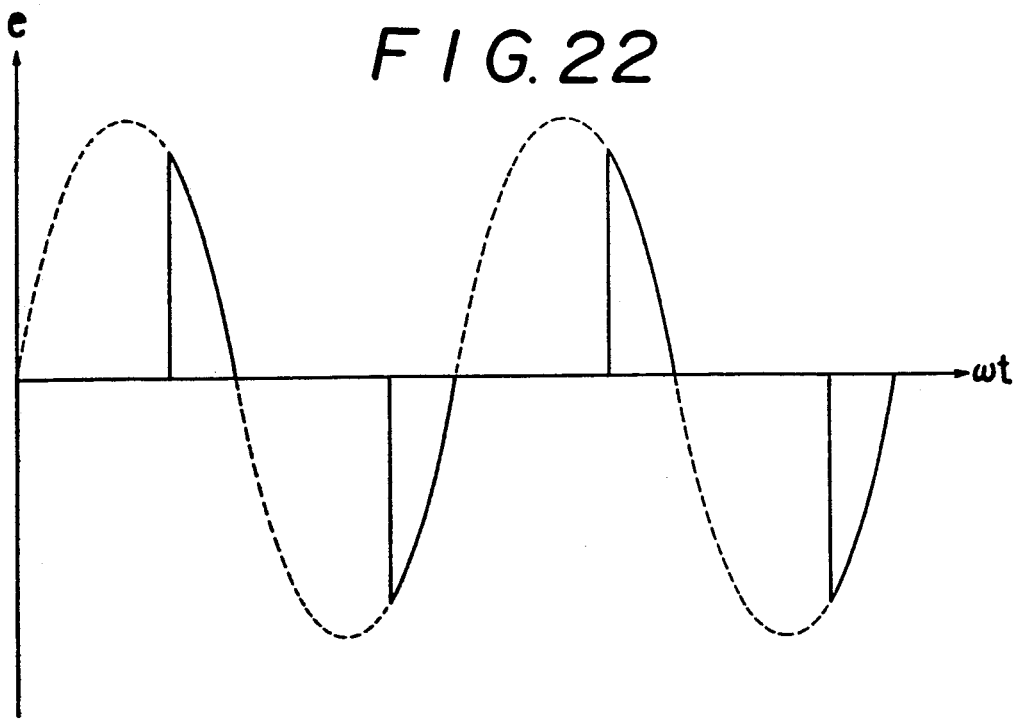
FIGS. 22–26 are diagrams illustrating voltage waveforms when variable resistance of the phase control circuit is set high.
Figure 23:
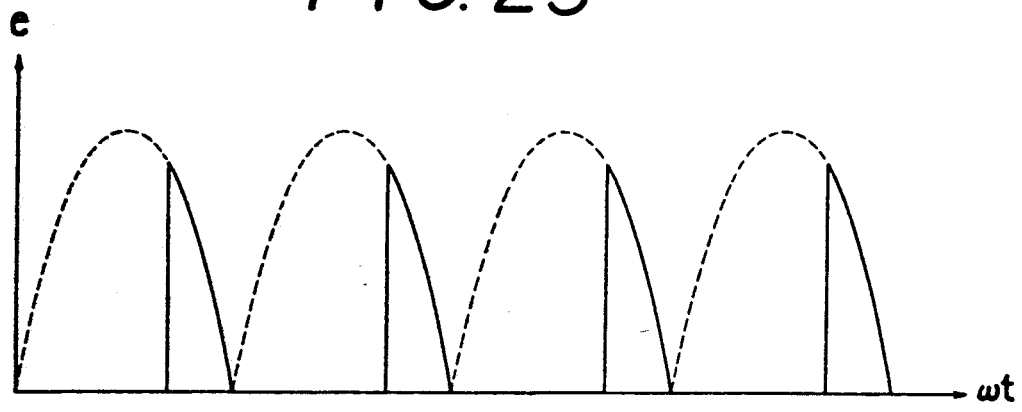
Figure 24:
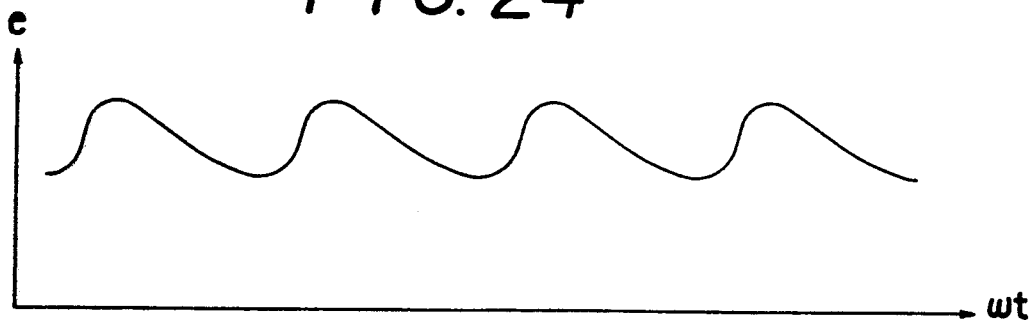
Figure 25:
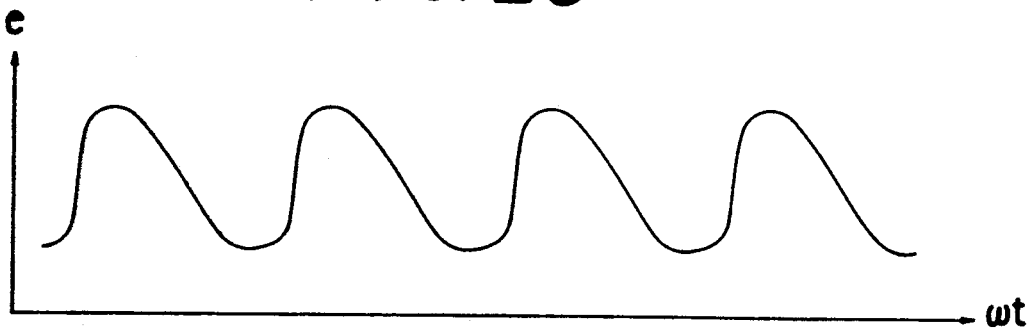
Figure 26:
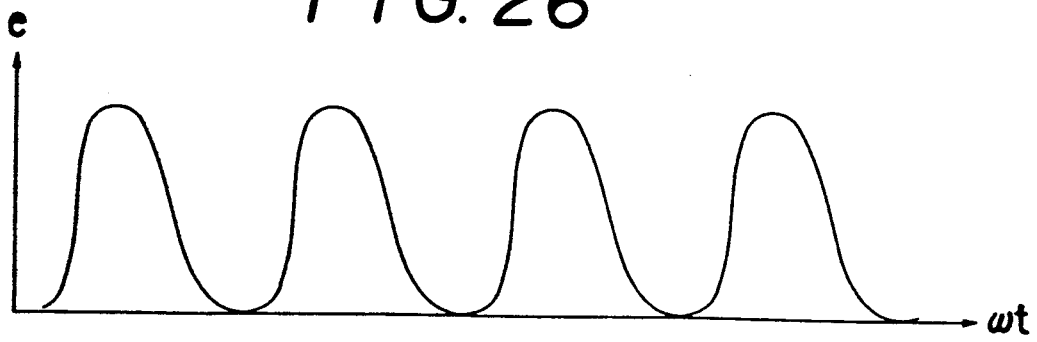

In the modification shown in FIGS. 21 through 26, the resistance of the variable resistor VR of the phase control circuit A" to constitute the pulsating waveform generating circuit B" is varied, such that the trigger T is triggered through the charging and discharging function of the capacitor C2 and the conduction angle in the triac T can be varied. For example, when the resistance of the variable resistor VR is set high, the conduction angle in the triac T is narrowed such that a voltage waveform as shown in FIG. 22 can be obtained. The AC input voltage controlled by the phase control circuit A is inputted to the bridge rectifier circuit RE and rectified in full wave, such that a pulsating waveform rising in mountain-like shape with definite period as shown in FIG. 23 (full-wave rectification partial sinusoidal wave) can be obtained. When the switch S is opened, the input voltage having the waveform as shown in FIG. 23 is impressed to the motor M as it is, such that the motor is operated at low voltage. Also when the switch S is closed, in a manner similar to the fifth embodiment, potential due to the charging and discharging function of the electrolytic capacitor C1 is added to the potential of the above-mentioned waveform, such that the high input voltage waveform as shown in FIG. 24 can be obtained in the no load state of the motor M. When the high input voltage is impressed to the motor M and a normal load is applied to the motor M, the motor M is rotated at a high torque by the input voltage waveform as shown in FIG. 25. If an excessive load is applied to the motor M, the potential of the electrolytic capacitor C is rapidly decreased so that the input voltage waveform as shown in FIG. 26 can be obtained. Thus the input voltage waveform of the motor M becomes nearly equivalent to the full-wave rectified waveform as shown in FIG. 23. That is, in a manner similar to the fifth embodiment, irrespective of the level setting of the motor input voltage by the switch S, the input voltage of the motor M becomes nearly equivalent and danger to the human body is prevented when an excessive load is applied.

Although the resistance of the variable resistor VR is set high in the description of the embodiment, the variable resistor VR can be suitably varied such that the motor input voltage can be set in a stepless state through variation of the conduction angle of the triac T.

I claim:

1. A massage machine comprising:

a housing having a top plate;

a pair of rotary shafts rotatably mounted to said housing and extending from inside of said housing through said top plate of said housing, each of said rotary shafts including a vertical shaft portion at a lower end thereof adapted to rotate about a vertical axis, and an oblique shaft portion extending upwardly from said vertical shaft portion at an oblique angle relative thereof;

a pair of kneading balls mounted to upper ends of said pair of rotary shafts, respectively;

rotating means for rotating said rotary shafts such that said kneading balls revolve about said vertical axis along a path; and a pair of sleeves mounted about said pair of rotary shafts, respectively, each of said sleeves including a vertical cylindrically shaped bushing portion surrounding said vertical shaft portion of one of said rotary shafts, a conically shaped taper portion surrounding said oblique shaft portion of said one of said rotary shafts, and a partially spherically shaped cover piece extending outwardly and downwardly from a top edge of said taper portion and surrounding said taper portion, said cover piece being mounted such that the one of said kneading balls mounted to said one of said rotary shafts circulates along an outer surface of said cover piece when said one of said rotary shafts is rotated by said rotating means.

2. A massage machine as recited in claim 1, further comprising a spacer mounted about said pair of rotary shafts; and wherein bottom edges of said cover pieces contact an upper surface of said spacer.

3. A massage machine as recited in claim 1, further comprising a plurality of elastic stays mounted to said housing and extending upwardly above said top plate;

a vibration plate mounted to said plurality of elastic stays above said top plate; and vibration means for vibrating said vibration plate and said plurality of elastic stays.

4. A massage machine as recited in claim 3, wherein said plurality of elastic stays comprises at least three elastic stays mounted out of alignment with one another so as to support said vibration plate above said top plate.

5. A massage machine as recited in claim 4, wherein said vibration means comprises a vibration motor mounted in said housing spaced apart from said elastic stays, and a pair of vibration members mounted between said vibration motor and said vibration plate to transmit vibratory motion from said vibration motor to said vibration plate.

6. A massage machine as recited in claim 1, further comprising a cover member for covering aid kneading balls; and means for detachably connecting said cover member to said top plate of said housing such that said cover member covers said kneading balls.

7. A massage machine as recited in claim 6, wherein an opening is formed in said top plate and said rotary shafts extend through said opening; and said connecting means comprises an upwardly extending wall extending about a periphery of said opening, at least one flange extending outwardly from an upper end of said wall, and fastening means for detachably fastening a bottom peripheral edge of said cover member about said wall beneath said at least one flange.

8. A massage machine as recited in claim 7, wherein said bottom peripheral edge of said cover member includes an insertion passage formed therein; and said fastening means comprises a string inserted through said insertion passage.

9. A massage machine as recited in claim 8, wherein a tying space is formed peripherally about said wall; and a panel member is removably mounted to said top plate in covering relation to said tying space.

10. A massage machine as recited in claim 9, wherein a plurality of engaging holes are formed through said top plate adjacent said tying space; and said panel member has a plurality of engaging pieces extending downwardly therefrom and adapted to engage in said plurality of engaging holes, respectively.

11. A massage machine as recited in claim 7, further comprising a spacer mounted adjacent said opening formed in said top plate about said bushing portions of both of said sleeves and within said peripheral wall.

12. A massage machine as recited in claim 1, wherein said rotating means comprises an electric motor mounted in said housing, and a phase control means for controlling operation of said electric motor.

13. A massage machine as recited in claim 12, wherein said rotating means further comprises an overgrasping prevention means for preventing said kneading balls from overgrasping a body part by reducing the speed of rotation of said rotary shafts when said kneading balls reach predetermined grasping positions.

14. A massage machine as recited in claim 13, wherein said overgrasping prevention means comprises a magnet mounted eccentrically for rotation with one of said rotary shafts, and a lead switch mounted to said housing in a fixed position aligned with said magnet in a particular rotary position of said one of said rotary shafts, said lead switch being connected to said phase control means.

15. A massage machine as recited in claim 14, wherein said rotating means further includes a pair of worm wheels fixed for rotation with said pair of rotary shafts, respectively, and a shaft, operatively connected with said worm wheels, extending from said electric motor; and said magnet is mounted on one of said worm wheels.

16. A massage machine as recited in claim 12, wherein said rotating means further comprises a rotation stop prevention means for preventing stoppage of the rotation of said rotary shafts due to an excessive load on said electric motor.

17. A massage machine as recited in claim 16, wherein said phase control circuit includes a light receiving element and a variable resistor in parallel with said light receiving element; and said rotation stop prevention mechanism comprises a rectifier circuit connected to said electric motor, a resistor connected in series between said electric motor and said rectifier circuit, and a light emission element connected in parallel with said resistor and in parallel with and opposed to said light receiving element.

18. A massage machine as recited in claim 1, wherein said rotating means comprises an electric motor operatively coupled to said rotary shafts, and a stop torque variation prevention means for preventing variation of the stop torque of said electric motor.

19. A massage machine as recited in claim 18, wherein said stop torque variation prevention means comprises a pulsating waveform generating circuit connected to said electric motor for generating a rectified wave with a definite period, said pulsating waveform generating circuit being connectable to an AC power source, and a capacitor and a switch connected in parallel with aid electric motor.

* * * * *